US012677959B2

(12) United States Patent
Hill et al.

(10) Patent No.: US 12,677,959 B2
(45) Date of Patent: Jul. 14, 2026

(54) NOISE REDUCTION AND CANCELLATION SYSTEM FOR BEDS

(71) Applicant: Sleep Number Corporation, Minneapolis, MN (US)

(72) Inventors: Carli Hill, Oxnard, CA (US); Joseph Ermalovich, Santa Barbara, CA (US); Lori MacLachlan, Minneapolis, MN (US)

(73) Assignee: Sleep Number Corporation

( * ) Notice: Subject to any disclaimer, the term of this patent is extended or adjusted under 35 U.S.C. 154(b) by 831 days.

(21) Appl. No.: 18/087,973

(22) Filed: Dec. 23, 2022

(65) Prior Publication Data

US 2023/0210274 A1 Jul. 6, 2023

Related U.S. Application Data

(60) Provisional application No. 63/295,224, filed on Dec. 30, 2021.

(51) Int. Cl.

| | |
|---|---|
| ***A47C 31/00*** | (2006.01) |
| ***A47C 19/02*** | (2006.01) |
| ***A47C 19/22*** | (2006.01) |

(52) U.S. Cl.

CPC ..... *A47C 31/004* (2013.01); *A47C 19/022* (2013.01); *A47C 19/22* (2013.01)

(58) Field of Classification Search

CPC ..... A47C 19/022; A47C 19/22; A47C 19/02; A47C 19/021; A47C 21/003;

(Continued)

(56) References Cited

U.S. PATENT DOCUMENTS 2,375,941 A * 5/1945 Nostrand ..... A47C 21/00 4/607

4,305,168 A 12/1981 Holter et al.

(Continued)

FOREIGN PATENT DOCUMENTS

BE 1018110 5/2010

DE 202014008783 U1 * 12/2014 ..... G10K 11/17875

(Continued)

OTHER PUBLICATIONS

U.S. Appl. No. 16/719,177, filed Dec. 18, 2019, Nunn et al.

(Continued)

*Primary Examiner* — Matthew Troutman
*Assistant Examiner* — Alison N Labarge
(74) *Attorney, Agent, or Firm* — Norton Rose Fulbright US LLP

(57) ABSTRACT

Described are bed systems with headboards having a main headboard portion, a left wing attached to a first lateral edge and a right wing attached to a second lateral edge of the main headboard portion, and sound insulation material and insulation supports in each of the main headboard portion and the left and right wings. The insulation supports can be spaced apart to form cavities that can be filled in by the sound insulation material. The sound insulation material can be wool batten insulation. The bed system can also include speakers integrated into the left and right wings that allow a user to play audio, such as white and/or pink noise, to cancel surrounding noise. The bed system can also include microphones and a controller that can drive the speakers to cancel noise detected by the microphones.

20 Claims, 12 Drawing Sheets

(58) Field of Classification Search
CPC ..... A47C 31/004; A47C 17/86; E04B 1/86; E04B 2001/8423; A47G 9/1045
See application file for complete search history.

(56) References Cited

U.S. PATENT DOCUMENTS

| | | | | |
|---|---|---|---|---|
| 4,428,454 | A * | 1/1984 | Capaul | E04B 1/86 181/290 |
| 5,790,994 | A * | 8/1998 | Leonard | A47C 19/005 5/183 |
| 6,984,057 | B1 * | 1/2006 | Rogers | A47C 21/003 362/253 |
| 7,835,529 | B2 * | 11/2010 | Hernandez | G10K 11/1783 381/71.8 |
| 8,444,558 | B2 | 5/2013 | Young et al. | |
| 8,672,853 | B2 | 3/2014 | Young | |
| 8,984,687 | B2 | 3/2015 | Stusynski et al. | |
| 9,257,113 | B2 | 2/2016 | Ni et al. | |
| 9,370,457 | B2 | 6/2016 | Nunn et al. | |
| 9,384,727 | B2 | 7/2016 | Booij et al. | |
| 9,392,879 | B2 | 7/2016 | Nunn et al. | |
| 9,445,751 | B2 | 9/2016 | Young et al. | |
| 9,504,416 | B2 | 11/2016 | Young et al. | |
| 9,510,688 | B2 | 12/2016 | Nunn et al. | |
| 9,635,953 | B2 | 5/2017 | Nunn et al. | |
| 9,770,114 | B2 | 9/2017 | Brosnan et al. | |
| 9,844,275 | B2 | 12/2017 | Nunn et al. | |
| 9,931,085 | B2 | 4/2018 | Young et al. | |
| 10,058,467 | B2 | 8/2018 | Stusynski et al. | |
| 10,092,242 | B2 | 10/2018 | Nunn et al. | |
| 10,149,549 | B2 | 12/2018 | Erko et al. | |
| 10,182,661 | B2 | 1/2019 | Nunn et al. | |
| 10,201,234 | B2 | 2/2019 | Nunn et al. | |
| 10,226,133 | B2 | 3/2019 | Katz | |
| 10,251,489 | B1 * | 4/2019 | Stone | A63B 23/03566 |
| 10,251,490 | B2 | 4/2019 | Nunn et al. | |
| 10,342,358 | B1 | 7/2019 | Palashewski et al. | |
| 10,441,086 | B2 | 10/2019 | Nunn et al. | |
| 10,441,087 | B2 | 10/2019 | Karschnik et al. | |
| 10,448,749 | B2 | 10/2019 | Palashewski et al. | |
| 10,492,969 | B2 | 12/2019 | Stusynski et al. | |
| 10,632,032 | B1 | 4/2020 | Stusynski et al. | |
| 10,646,050 | B2 | 5/2020 | Nunn et al. | |
| 10,674,832 | B2 | 6/2020 | Brosnan et al. | |
| 10,716,512 | B2 | 7/2020 | Erko et al. | |
| 10,729,255 | B2 | 8/2020 | Erko et al. | |
| 10,736,432 | B2 | 8/2020 | Brosnan et al. | |
| 10,750,875 | B2 | 8/2020 | Palashewski et al. | |
| 10,827,846 | B2 | 11/2020 | Karschnik et al. | |
| 10,881,219 | B2 | 1/2021 | Nunn et al. | |
| 10,957,335 | B2 | 3/2021 | Demirli et al. | |
| 10,959,535 | B2 | 3/2021 | Karschnik et al. | |
| D916,745 | S | 4/2021 | Stusynski et al. | |
| 10,980,351 | B2 | 4/2021 | Nunn et al. | |
| 11,096,849 | B2 | 8/2021 | Stusynski et al. | |
| 11,122,909 | B2 | 9/2021 | Palashewski et al. | |
| 11,160,683 | B2 | 11/2021 | Nunn et al. | |
| 11,206,929 | B2 | 12/2021 | Palashewski et al. | |
| D954,725 | S | 6/2022 | Stusynski et al. | |
| D968,436 | S | 11/2022 | Stusynski et al. | |
| D975,121 | S | 1/2023 | Stusynski et al. | |
| 2008/0077020 | A1 | 3/2008 | Young et al. | |
| 2010/0170043 | A1 | 7/2010 | Young et al. | |
| 2011/0025915 | A1 * | 2/2011 | Daban | A47C 7/72 348/E7.001 |
| 2011/0144455 | A1 | 6/2011 | Young et al. | |
| 2012/0163626 | A1 | 6/2012 | Booij et al. | |
| 2014/0277822 | A1 | 9/2014 | Nunn et al. | |
| 2016/0015184 | A1 | 1/2016 | Nunn et al. | |
| 2016/0367039 | A1 | 12/2016 | Young et al. | |
| 2017/0065220 | A1 | 3/2017 | Young et al. | |
| 2017/0128001 | A1 | 5/2017 | Torre et al. | |
| 2017/0143269 | A1 | 5/2017 | Young et al. | |
| 2018/0310720 | A1 * | 11/2018 | Holland | A47C 31/004 |
| 2019/0053761 | A1 | 2/2019 | Torre et al. | |
| 2019/0069840 | A1 | 3/2019 | Young et al. | |
| 2019/0200777 | A1 | 7/2019 | Demirli et al. | |
| 2019/0201265 | A1 | 7/2019 | Sayadi et al. | |
| 2019/0201266 | A1 | 7/2019 | Sayadi et al. | |
| 2019/0201267 | A1 | 7/2019 | Demirli et al. | |
| 2019/0201268 | A1 | 7/2019 | Sayadi et al. | |
| 2019/0201270 | A1 | 7/2019 | Sayadi et al. | |
| 2019/0201271 | A1 | 7/2019 | Grey et al. | |
| 2019/0328146 | A1 | 10/2019 | Palashewski et al. | |
| 2019/0328147 | A1 | 10/2019 | Palashewski et al. | |
| 2020/0315367 | A1 | 10/2020 | Demirli et al. | |
| 2020/0336010 | A1 | 10/2020 | Holmvik et al. | |
| 2020/0337470 | A1 | 10/2020 | Sayadi et al. | |
| 2020/0359807 | A1 | 11/2020 | Brosnan et al. | |
| 2020/0367663 | A1 | 11/2020 | Nunn et al. | |
| 2020/0405070 | A1 | 12/2020 | Palashewski et al. | |
| 2020/0405240 | A1 | 12/2020 | Palashewski et al. | |
| 2021/0000261 | A1 | 1/2021 | Erko et al. | |
| 2021/0034989 | A1 | 2/2021 | Palashewski et al. | |
| 2021/0045541 | A1 | 2/2021 | Nunn et al. | |
| 2021/0068552 | A1 | 3/2021 | Palashewski et al. | |
| 2021/0112992 | A1 | 4/2021 | Nunn et al. | |
| 2021/0267380 | A1 | 9/2021 | Stusynski | |
| 2021/0282570 | A1 | 9/2021 | Karschnik et al. | |
| 2021/0289947 | A1 | 9/2021 | Karschnik et al. | |
| 2021/0314405 | A1 | 10/2021 | Demirli et al. | |
| 2021/0346218 | A1 | 11/2021 | Stusynski et al. | |
| 2022/0000273 | A1 | 1/2022 | Palashewski et al. | |
| 2022/0000654 | A1 | 1/2022 | Nunn et al. | |
| 2022/0110464 | A1 * | 4/2022 | Sutton | A45C 7/0059 |
| 2022/0225786 | A1 | 7/2022 | Palashewski et al. | |
| 2022/0265059 | A1 | 8/2022 | Palashewski et al. | |
| 2022/0305231 | A1 | 9/2022 | Stusynski et al. | |
| 2022/0346565 | A1 | 11/2022 | Karschnik et al. | |
| 2022/0354431 | A1 | 11/2022 | Molina et al. | |
| 2022/0386947 | A1 | 12/2022 | Molina et al. | |
| 2022/0395233 | A1 | 12/2022 | Siyahjani et al. | |
| 2023/0018558 | A1 | 1/2023 | Demirli et al. | |
| 2023/0035257 | A1 | 2/2023 | Karschnik et al. | |
| 2023/0037482 | A1 | 2/2023 | Demirli et al. | |
| 2023/0054736 | A1 | 2/2023 | Holmvik et al. | |
| 2023/0063373 | A1 | 3/2023 | Young et al. | |
| 2023/0142604 | A1 | 5/2023 | Dixon et al. | |
| 2023/0148762 | A1 | 5/2023 | Karschnik et al. | |

FOREIGN PATENT DOCUMENTS

| | | | | |
|---|---|---|---|---|
| DE | 202017107458 | U1 * | 1/2018 | A47C 19/022 |
| EP | 2111776 | | 10/2009 | |
| GB | 2510165 | A * | 7/2014 | A61H 23/0263 |
| KR | 102151988 | B1 * | 9/2020 | E04F 13/0875 |
| WO | WO-2013131175 | A1 * | 9/2013 | A47C 21/003 |

OTHER PUBLICATIONS

U.S. Appl. No. 17/745,508, filed May 16, 2022, Nunn et al.
U.S. Appl. No. 17/986,351, filed Nov. 14, 2022, Nunn et al.
U.S. Appl. No. 18/075,913, filed Dec. 6, 2022, Johnston et al.
U.S. Appl. No. 18/084,944, filed Dec. 20, 2022, Molina.
U.S. Appl. No. 18/086,003, filed Dec. 21, 2022, Kirk et al.
U.S. Appl. No. 18/086,104, filed Dec. 21, 2022, Hill et al..
U.S. Appl. No. 18/087,078, filed Dec. 22, 2022, Hill et al..
U.S. Appl. No. 18/087,973, filed Dec. 23, 2022, Hill et al.
U.S. Appl. No. 18/091,713, filed Dec. 30, 2022, MacLachlan et al.
U.S. Appl. No. 18/105,468, filed Feb. 3, 2023, Sayadi et al.
U.S. Appl. No. 18/135,448, filed Apr. 17, 2023, Demirli et al.
U.S. Appl. No. 18/199,255, filed May 18, 2023, Sayadi et al.
U.S. Appl. No. 18/199,750, filed May 19, 2023, Sayadi et al.
U.S. Appl. No. 18/204,141, filed May 31, 2023, Palashewski et al.
U.S. Appl. No. 29/814,835, filed Nov. 9, 2021, Dixon et al.
U.S. Appl. No. 29/837,293, filed May 4, 2022, Stusynski et al.
U.S. Appl. No. 29/881,955, filed Jan. 9, 2023, Stusynski et al.
International Preliminary Report on Patentability in International Appln. No. PCT/US2022/053917, mailed on Jun. 20, 2024, 12 pages.

(56) References Cited

OTHER PUBLICATIONS

International Search Report and Written Opinion in International Appln. No. PCT/US2022/053917, mailed on Jul. 3, 2023, 20 pages.

* cited by examiner

NOISE REDUCTION AND CANCELLATION SYSTEM FOR BEDS

INCORPORATION BY REFERENCE

This application claims priority to U.S. Provisional Application Ser. No. 63/295,224, filed on Dec. 30, 2021, the disclosure of which is incorporated by reference in its entirety.

TECHNICAL FIELD

This document describes devices, systems, and methods generally related to a bed system for reducing and/or cancelling noise in a sleep environment.

BACKGROUND

In general, a bed is a piece of furniture used as a location to sleep or relax. Many modern beds include a soft mattress on a bed frame. The mattress may include springs, foam material, and/or an air chamber to support the weight of one or more occupants.

SUMMARY

The document generally relates to a bed system for reducing and/or cancelling noise in a surrounding environment. More specifically, a headboard can include sound insulation material integrated into the headboard's structure in order to reduce an amount of noise in a sleep environment. The headboard's structure can include insulation supports, such as 2×4 boards, that extend from top to bottom portions of the headboard. Cavities can form between adjacent insulation supports. Each cavity can be filled with a sheet of the sound insulation material.

The headboard can also include left and right wings. The left and right wings can have a similar structure as the headboard's structure. For example, each of the left and right wings structure can include insulation supports. Cavities formed between adjacent insulation supports in each of the left and right wings can be filled with a sheet of the sound insulation material. The wings can therefore provide for additional noise reduction closest to a sleeper's head.

Speakers can also be integrated into the headboard, such as in the left and right wings of the headboard, for noise cancellation. A user of the bed system can connect their user device (e.g., mobile phone) to the speakers via Bluetooth to play white and/or pink noise through the speakers. Such noise cancellation techniques can be used to reduce or otherwise cancel noise in the surrounding environment and/or noise due to snoring by the user's partner, who may be also in the bed system. The user can select what noise is played through the speakers, volume, and/or how long the noise should play.

In some implementations, one or more microphones or other sound sensors can be integrated throughout the bed system and used for active noise cancelling techniques. For example, microphones can be integrated into portions of a foundation of the bed system, such as a foot board and side rails. Microphones can also be integrated into the headboard and/or the left and right wings. The microphones can detect noise in the surrounding environment, such as snore and other noises. A controller of the bed system can calculate and determine a sound wave for the detected noise and then generate an inverse sound wave. The inverse sound wave can be played through the speakers of the bed system. Although the inverse sound wave may not sound like white noise, the inverse sound wave can give off an effect of quieting or otherwise canceling out surrounding noises.

One or more embodiments described herein can include a bed system including a headboard having a main headboard portion, a left wing attached to a first lateral edge of the main headboard portion, a right wing attached to a second lateral edge of the main headboard portion, sound insulation material positioned in each of the main headboard portion, the left wing, and the right wing, and insulation supports positioned in each of the main headboard portion, the left wing, and the right wing. The left and right wings can be positioned opposite of each other.

In some implementations, the embodiments described herein can optionally include one or more of the following features. For example, the bed system further can include a mattress and the left and right wings can extend a length along lateral edges of the mattress. As another example, the insulation supports can extend from top portions to bottom portions of the each of the main headboard portion, the left wing, and the right wing, the insulation supports can be spaced apart such that the insulation supports form cavities, and the sound insulation material can be configured to fill in the cavities. The sound insulation material can include a first layer of glue that attaches the sound insulation material to the insulation supports, a second layer of high density sound insulation board that attaches to the first layer, and a third layer of wear resistant felt material that attaches to the second layer. The sound insulation material can be approximately 10-60 mm thick. The sound insulation material can also be configured to reduce 10-40 dB of noise. In some implementations, the sound insulation material can be at least one of wool batten insulation, high density foam, wool, polyurethane foam, melamine foam, mineral wool, rock wool, fiberglass, and acoustic fabric. Moreover, the headboard can be wrapped in an upholstery material, and the sound insulation material can bond to an internal facing side of the upholstery material. The headboard can be 3-4 inches thick. Each of the left wing and the right wing can extend 10-15 inches from the first lateral edge and the second lateral edge of the main headboard portion, respectively.

As another example, the insulation supports can extend vertically to define cavities between adjacent insulation supports. The sound insulation material can be positioned in the cavities between the adjacent insulation supports. Each of the insulation supports can be an elongate structure extending from a headboard top to a headboard bottom, and the cavities can be elongate and extending from the headboard top to the headboard bottom. Each of the cavities can be undivided from the headboard top to the headboard bottom. The sound insulation material can be a sheet that fills an entire cavity formed between adjacent insulation supports. The insulation supports can be elongate wooden boards extending between a headboard top board and a headboard bottom board. The insulation supports can define only a single cavity in each of the left and right wings and can define a plurality of cavities in the main headboard portion.

As yet another example, the bed system can also include speakers integrated into the left and right wings. The speakers can be configured to connect by Bluetooth to a user device and play audio through the speakers. The audio can be at least one of white noise and pink noise. The bed system can also include a remote control that can be configured to adjust volume of the audio, turn off the audio, and set a timer to automatically turn off the audio.

The bed system can also include speakers integrated into each of the main headboard portion, the left wing, and the right wing, one or more microphones integrated into at least one of the main headboard portion, the left wing, and the right wing, and a controller operably connected to the one or more microphones and the speakers. The controller can be configured to drive the speakers to cancel noise as a function of input from the one or more microphones. The controller can also receive sensed audio data from the one or more microphones, determine, based on the sensed audio data, whether noise in at least one of (i) an environment surrounding the bed system and (ii) an environment in the bed system exceeds a threshold level of noise, and drive, based on determining that the noise exceeds the threshold level of noise, the speakers to cancel the noise. In some implementations, driving the speakers to cancel the noise can include playing at least one of white noise and pink noise from the speakers for a threshold period of time. The threshold period of time can be determined, by the controller, based on sensed audio data that is received from the one or more microphones.

In some implementations, the bed system can include a noise cancelling system that includes at least one speaker and a controller operably connected to the at least one speaker. The controller can be configured to drive the at least one speaker to cancel noise in an environment surrounding the bed system.

In yet some implementations, the left wing can include a zipper that extends vertically down a portion of the left wing proximate a rear edge of the left wing and terminates at a bottom edge of the left wing, and the right wing can include a zipper that extends vertically down a portion of the right wing proximate a rear edge of the right wing and terminates at a bottom edge of the right wing. The zipper of the left wing may be hidden from sight when the left wing attaches to the first lateral edge of the main headboard portion and the zipper of the right wing may be hidden from sight when the right wing attaches to the second lateral edge of the main headboard portion. The zipper of the left wing can be configured to unzip from the bottom edge of the left wing and expose an interior portion of the left wing that may include at least one of the speakers integrated into the left wing. The at least one of the speakers can be removable and replaceable. The zipper of the right wing can be configured to unzip from the bottom edge of the right wing and expose an interior portion of the right wing that may include at least one other of the speakers integrated into the right wing. The at least one other of the speakers can be removable and replaceable.

The bed system can also include an insulation support frame that can extend around a perimeter of a headboard cavity formed inside the main headboard portion, the insulation support frame including: a first subset of the insulation supports that can extend from a top portion to a bottom portion of the main headboard portion inside the headboard cavity, and a second subset of the insulation supports that can extend from a first lateral edge to a second lateral edge of the main headboard portion inside the headboard cavity. The first subset of the insulation supports and the second subset of the insulation supports can intersect inside the headboard cavity to form insulation cavities, and the sound insulation material can be configured to fill in the insulation cavities. The sound insulation material can be a sheet of sound insulation material that mounts to a front side of the insulation support frame that is opposite and closer to a front end of the main headboard portion than a back end of the main headboard portion. A back end of the main headboard portion can be open and a front end and lateral sides of the main headboard portion can be covered in an upholstery material. The insulation supports can extend vertically and horizontally to define cavities between adjacent and perpendicular insulation supports, the sound insulation material being positioned in the cavities between the adjacent and perpendicular insulation supports. In some implementations, a first subset of the insulation supports can include elongate structures extending from a headboard top to a headboard bottom, a second subset of the insulation supports can include elongate structures extending from a first headboard side to a second headboard side, the second headboard side being opposite the first headboard side, and the cavities can be elongate sections divided from the headboard top to the headboard bottom and from the first headboard side to the second headboard side. Furthermore, the sound insulation material can be a sheet that fills an entire cavity formed between the adjacent and perpendicular insulation supports. The bed system can also include a sound insulation frame, the sound insulation frame having the insulation supports. The insulation supports can be elongate wooden boards extending between (i) a headboard top board and a headboard bottom board and (ii) a first headboard side board and a second headboard side board. The bed system can also include a sound insulation frame, the sound insulation frame having the headboard top board, the headboard bottom board, the first headboard side board, and the second headboard side board.

One or more embodiments described herein can include a bed system having a headboard that includes a sound insulation material comprising wool batten material.

The embodiments described herein can optionally include one or more of the following features. For example, the sound insulation material further can include a high density sound absorbing insulation material. The sound insulation material can also be a sheet of material.

One or more embodiments described herein can include a bed system having a headboard that includes a main headboard portion, a left wing attached to a first lateral edge of the main headboard portion, the left wing including a first speaker facing the right wing, and a right wing attached to a second lateral edge of the main headboard portion. The left and right wings can be positioned opposite of each other and the right wing can include a second speaker facing the left wing.

The embodiments described herein can optionally include one or more of the following features. For example, the bed system can also include one or more microphones, and a controller operably connected to the one or more microphones, the first speaker, and the second speaker. The controller can be configured to drive the first and second speakers to cancel noise as a function of input from the one or more microphones. The controller can also receive sensed audio data from the one or more microphones, determine, based on the sensed audio data, whether noise in an environment surrounding the bed system exceeds a threshold level of noise, and drive, based on determining that the noise exceeds the threshold level of noise, the first and second speakers to cancel the noise. In some implementations, driving the first and second speakers to cancel the noise can include playing at least one of white noise and pink noise from the first and second speakers for a threshold period of time. The threshold period of time can be determined, by the controller, based on sensed audio data that is received from the one or more microphones being less than the threshold level of noise.

In some implementations, a first microphone can be positioned in the left wing, a second microphone can be positioned in the right wing, and at least one microphone can be positioned in the main headboard portion. The bed system can also include a controller operably connected to the first and second speakers. The controller can be configured to drive the first and second speakers to produce at least one of white noise and pink noise. The first and second speakers can be configured to connect by Bluetooth to a user device and play audio through the first and second speakers.

In yet some implementations, the controller can receive user input to play audio through the first and second speakers, the audio being at least one of white noise and pink noise, and drive the first and second speakers to play the audio. The user input can be received from a user device in Bluetooth connection with the controller. The user input can also be received from a remote in wireless communication with the controller. Moreover, the controller can receive user input to adjust audio that is played through the first and second speakers, the audio being at least one of white noise and pink noise, and drive the first and second speakers to adjust the audio. The user input can be an indication to increase or decrease a volume of the audio that is played through the first and second speakers. The user input can also be an indication to turn off the audio that is played through the first and second speakers. The user input can also be an indication to turn off the audio that is played through the first and second speakers after a predetermined amount of time expires.

As another example, the bed system can include sound insulation material positioned in each of the main headboard portion, the left wing, and the right wing, and insulation supports positioned in each of the main headboard portion, the left wing, and the right wing. The sound insulation material can be configured to reduce noise in an environment surrounding the bed system. The sound insulation material can be a sheet that fills cavities formed between adjacent insulation supports. The sound insulation material can fill the cavities around the first and second speakers.

In some implementations, driving the first and second speakers to cancel the noise can include determining, by the controller, a sound wave of the noise in the environment surrounding the bed system, generating, by the controller, an inverse sound wave of the sound wave of the noise in the environment surrounding the bed system, and driving, by the controller, the first and second speakers to play the inverse sound wave. Moreover, the controller can receive sensed audio data from at least one microphone integrated into the left wing, determine, based on the sensed audio data, whether noise in an environment near the left wing exceeds a threshold level of noise, and drive, based on determining that the noise exceeds the threshold level of noise, the first speaker to cancel the noise. In some implementations, the controller can receive sensed audio data from at least one microphone integrated into the right wing, determine, based on the sensed audio data, whether noise in an environment near the right wing exceeds a threshold level of noise, and drive, based on determining that the noise exceeds the threshold level of noise, the second speaker to cancel the noise.

The devices, system, and techniques described herein may provide one or more of the following advantages. For example, the headboard structure can be secure and durable. The headboard structure can be engineered using high quality textiles, fine hardwoods, durable leather, and other materials that make the headboard sturdy. Moreover, the insulation supports of the headboard can provide structure so that the sound insulation material remains in place and is neither flimsy nor falling down within the headboard structure. The headboard may also have accented tailoring and layering of materials to provide an aesthetically pleasing appearance.

As another example, design of the headboard takes advantage of open spaces in the headboard structure that typically are not used. Typically, a headboard structure includes structural supports and cavities or open spaces between adjacent supports. Thus, a typical headboard structure may be hollow. Using the disclosed techniques, these cavities are filled in with sheets of sound insulation material, thereby capitalizing on open spaces in typical headboard structures to provide added benefits to users of the bed system. By filling in the cavities with the sound insulation material, noise in the surrounding sleep environment can be reduced.

Additionally, the disclosed techniques provide individual and automatic noise reduction and cancellation technology to improve the user's sleep quality. Using Bluetooth-integrated speakers, the user can decide how to mask in-bed and environmental noise to create a more peaceful sleep environment that leads to improved sleep quality. Using microphones integrated into the bed system, the bed system can automatically mask in-bed and environmental noise to also create a more peaceful sleep environment that leads to improved sleep quality.

Furthermore, while designed to support sleep needs for users of any age, the disclosed features of the bed system can also satisfy needs of a discrete aging population. Thus, the disclosed techniques can provide unique and dynamic abilities to adapt to any user of the bed system, no matter their needs.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

This document generally relates to a bed system for reducing and/or cancelling noise in a surrounding sleep environment (e.g., partner snore, external sounds, etc.). The bed system can include a headboard having insulation supports that provide structure to the headboard. Cavities (e.g., gaps, open spaces) between adjacent insulation supports in the headboard structure can be filled with sheets of sound insulation material. The sound insulation material can provide for reducing and/or cancelling noise in the surrounding sleep environment. Moreover, the headboard can include integrated speakers. A user of the bed system can connect their user device (e.g., mobile phone) to the speakers (e.g., via Bluetooth communication) to play white noise and/or pick noise through the speakers. The user can control the noise that is played through the speakers in order to reduce and/or cancel noise in the surrounding sleep environment. The bed system can also include integrated sound sensors, such as microphones. The microphones can detect noise in the surrounding sleep environment. A controller of the bed system can automatically generate white noise or noise similar to white noise that can be played through the speakers to reduce and/or cancel the detected noise in the surrounding sleep environment. As a result, the disclosed techniques can provide noise reduction and/or cancellation techniques that can improve overall sleep quality for users of the bed system.

Figure 1:
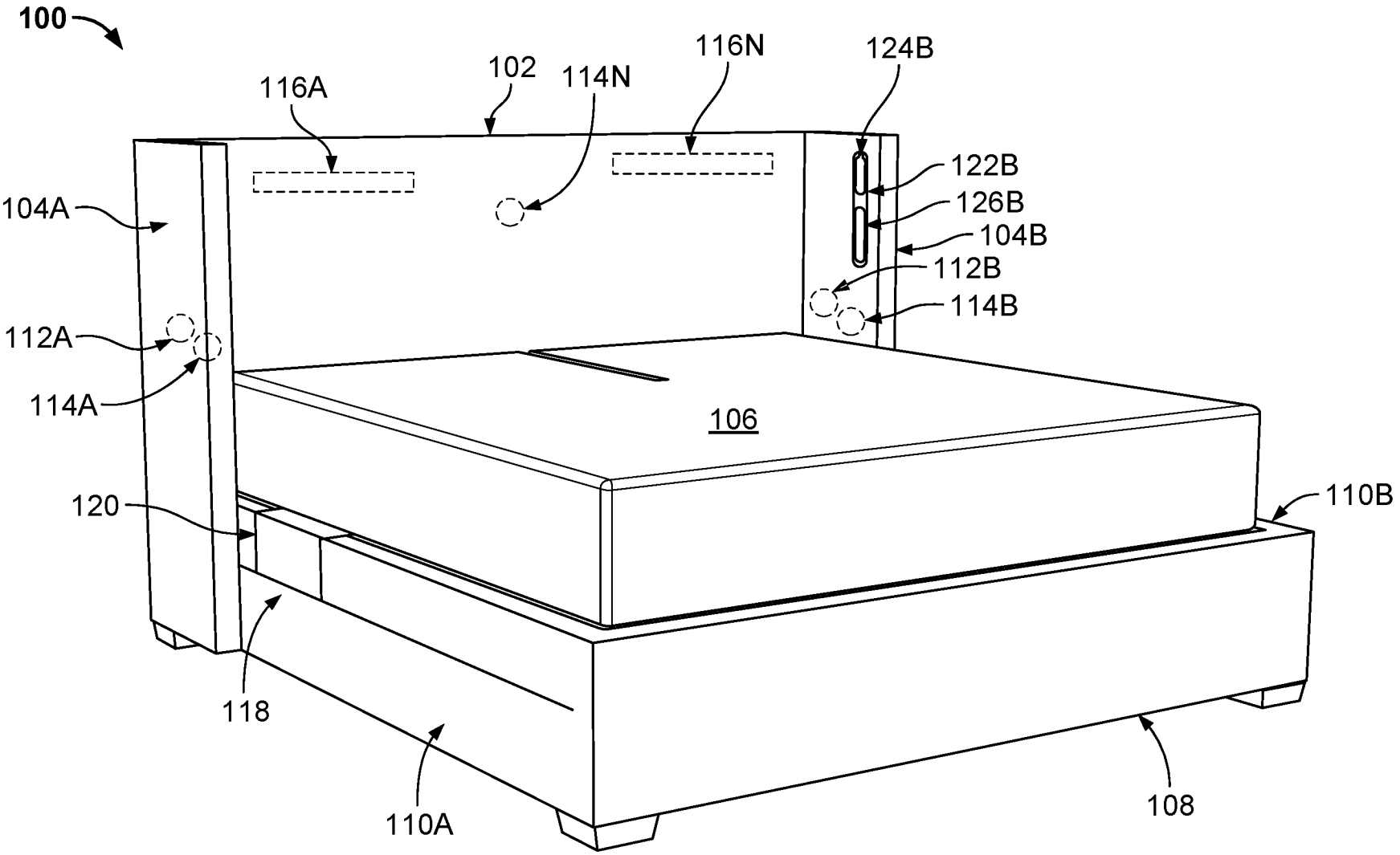
FIG. 1 depicts an example bed system.

Referring to the figures, FIG. 1 depicts an example bed system 100. The bed system 100 can include features that provide an improved sleep experience for a user of the bed system, including users having different age, conditions, demographics, and/or preferences.

The bed system 100 can include a headboard 102, foundation 108, and mattress 106. The mattress 106 can be sized for one user, such as a twin mattress. The mattress 106 can also be sized for two users, such as a full, queen, king, and/or California king mattress. As illustrated in FIG. 1, the mattress 106 can be a king mattress having a split top portion and a joined bottom portion. The mattress 106 can be an air mattress or other suitable mattress. The mattress 106 can also be articulable or stationary.

The headboard 102 can include a main headboard portion 201 and wings 104A and 104B. The wings 104A and 104B can extend a length along lateral edges of the mattress 106. In some implementations, the length can be 5 to 20 inches. In some implementations, the length can be 13 inches. For example, the wings 104A and 104B can extend to a length along the lateral edges of the mattress 106 that includes a head portion of the mattress 106 where the user may place their head on a pillow. As a result, the wings 104A and 104B can act as a barrier to some noises that may exist in a surrounding sleep environment.

The headboard 102 can include features for improving sleep experiences of the user of the bed system 100. For example, the headboard 102 can include speakers 112A and 112B, microphones 114A-N, lights 116A-N, docks 122A and 122B, reading lights 124A and 124B, and remotes 126A and 126B. The speakers 112A and 112B can be integrated into the wings 104A and 104B, respectively. The speakers 112A and 112B can be configured to play white and/or pink noise to reduce and/or cancel noise in the surrounding sleep environment. The user can connect one or more user devices (e.g. mobile phone, tablet, PC, or other computer) or another audio input to the speakers 112A and 112B (e.g., Bluetooth connection) to control audio that is played through the speakers 112A and 112B.

The microphones 114A and 114B can be integrated into the wings 104A and 104B, respectively. Additional microphones can also be integrated into other portions of the bed system 100. For example, the microphone 114N can be integrated into a midpoint of the headboard 102. Additional microphones can be integrated into the headboard 102 for each respective user/side of the mattress 106. The microphones 114A-N can be configured to detect noise in the surrounding sleep environment (such as snore or breathing sounds of one or both users, external noises, etc.). Based on the detected noise, the bed system 100 (e.g., a bed controller, such as controller 500 in FIGS. 5A-B) can generate an inverse sound wave to play through the speakers 112A and 112B to reduce and/or cancel the detected noise. As a result, the user of the bed system 100 can experience improved sleep quality undisturbed by noises in the surrounding sleep environment (e.g., snore or breathing sounds of one or both users, external noises, etc.).

The lights 116A-N can be integrated into a back portion of the headboard 102. The lights 116A-N, for example, can be recessed into the back portion of the headboard 102 and configured to provide ambient lighting that supports the user's circadian rhythm with wake and sleep routines.

The docks 122A and 122B can be integrated into the wings 104A and 104B, respectively. The docks 122A and 112B can house components such as the reading lights 124A and 124B, respectively, and the remotes 126A and 126B, respectively. These components can be kept in easy to access locations. In some embodiments, the user of the bed system 100 can access either of the reading lights 124A and 124B and/or the remotes 126A and 126B regardless of whether the user is laying down, sitting up, or otherwise inclined on the mattress 106. The reading lights 124A and 124B can extend out from the respective docks 122A and 122B and be tilted in a desired direction of the user. The user can also adjust the reading lights 124A and 124B color and intensity based on their particular needs and preferences. The remotes 126A and 126B can be used by the user to adjust their respective side of the bed system 100. For example, the remotes 126A and 126B can be used to adjust audio (e.g., volume level, turning audio on or off, setting a timer to automatically turn off the audio, etc.) that is played through the speakers 112A and 112B.

The foundation 108 includes side rails 110A and 110B. Pockets 118A and 118B (pocket 118B is not depicted in FIG. 1) can be integrated into the side rails 110A and 110B, respectively. The pockets 118A and 118B can be storage pockets for holding objects including but not limited to mobile devices (e.g., laptops, tablets, mobile phones, smart phones, etc.), books, magazines, and other items. The pockets 118A and 118B can include integrated inductive charging capabilities to charge one or more of the mobile devices placed therein. The pockets 118A and 118B can also include charging ports to provide wired charging of the mobile devices. The charging ports can include USB and USC ports. The pockets 118A and 118B can be integrated into portions of the side rails 110A and 110B that are easy to reach by the user of the bed system 100, regardless of whether the user is laying down, sitting up, or inclined to another position on the mattress 106.

Moreover, plates 120A and 120B (plate 120B is not depicted in FIG. 1) can be removably attached to a portion of the side rails 110A and 110B, respectively, that is aligned with and above the pockets 118A and 118B, respectively. The plates 120A and 120B can cover holes that are integrated into the side rails 110A and 110B and configured to receive and support side rail accessories. The side rail accessories (not shown in FIG. 1) can include tabletops and handrails, which can improve functionality of the bed system 100 and assist the user of the bed system 100 to get in and out of bed. The plates 120A and 120B can provide an aesthetically pleasing appearance of the foundation 108 when side rail accessories are not attached to the side rails 110A and 110B. When the side rail accessories are attached to either of the side rails 110A and 110B, the corresponding plate 120A or 120B can be removed so that the holes are exposed to receive supports of the side rail accessories.

Figure 2A:
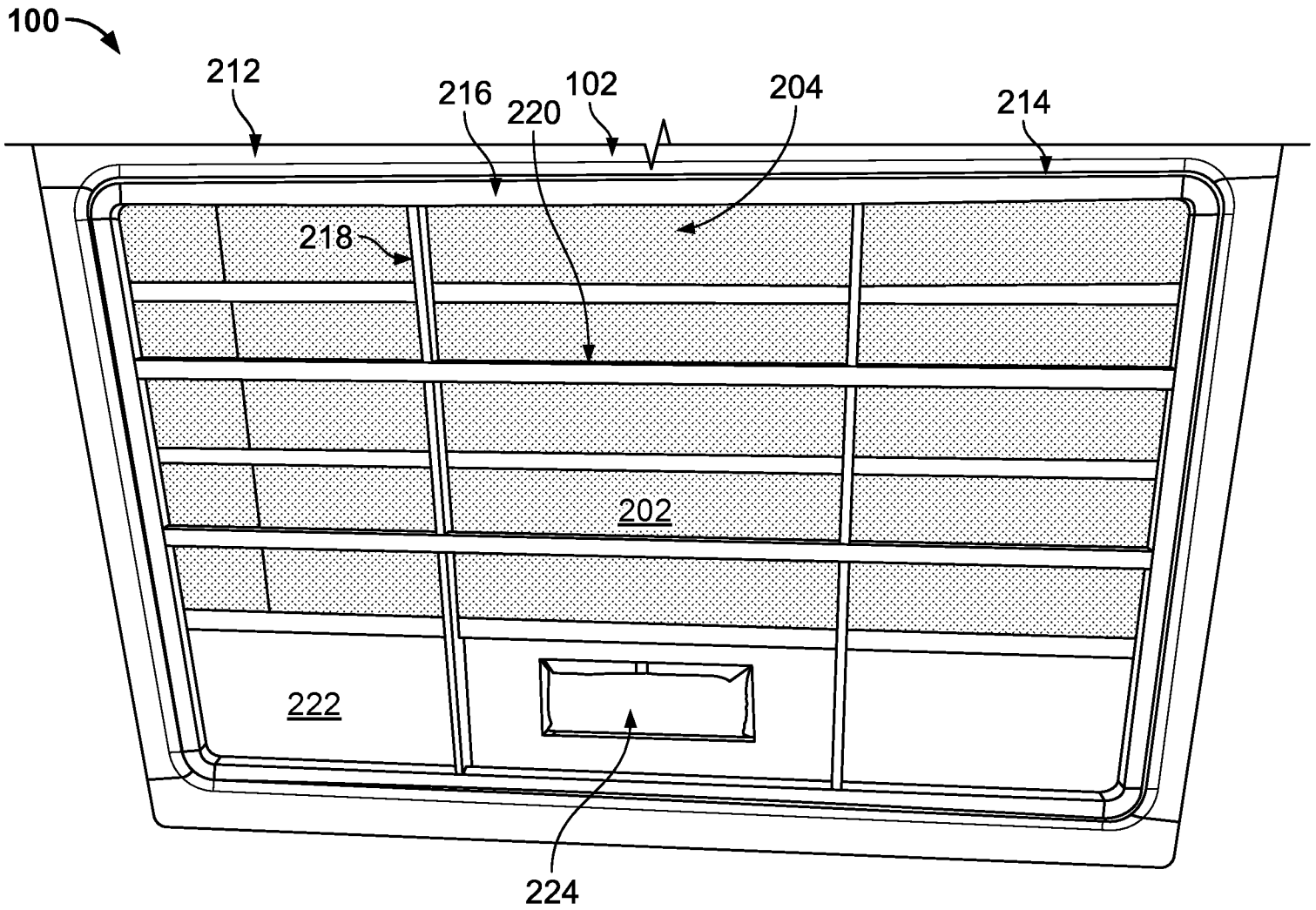
FIGS. 2A-C depict example headboard configurations with sound insulation material.
Figure 2B:
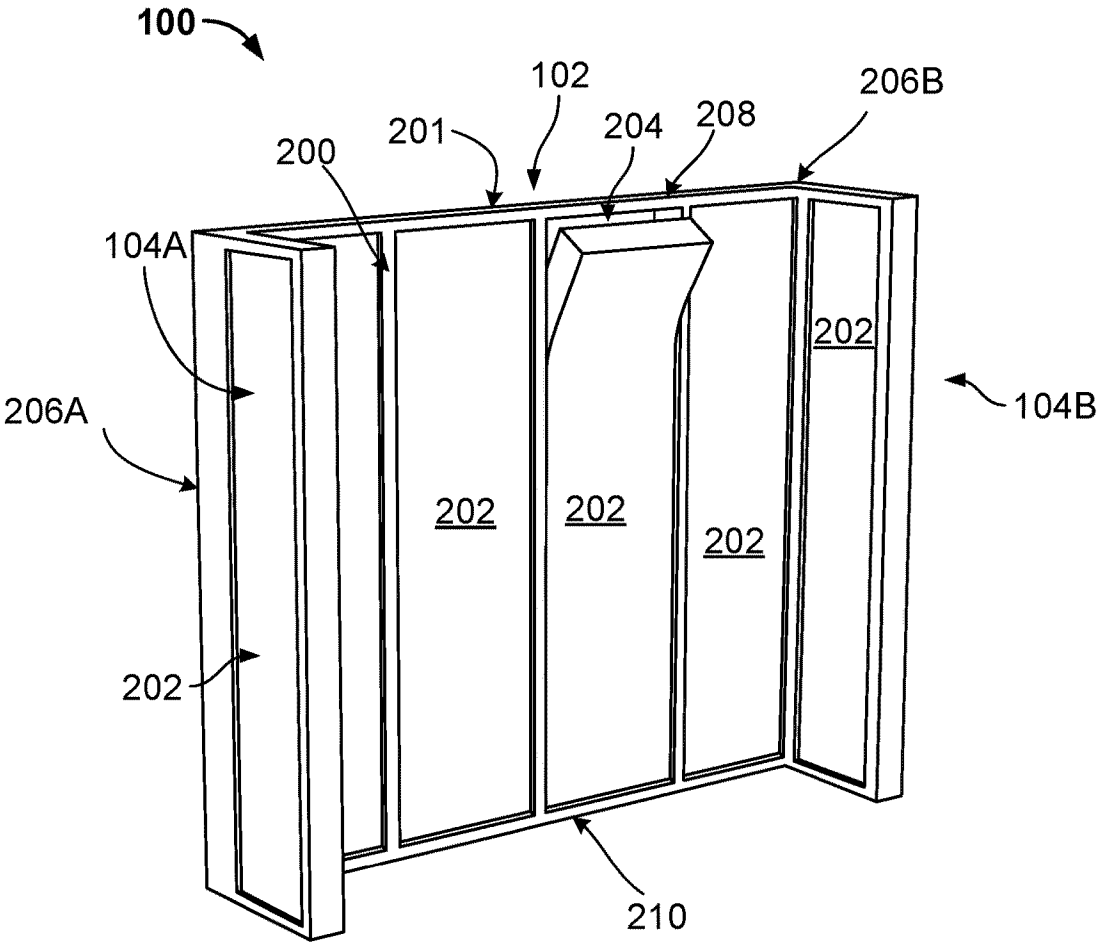
Figure 2C:
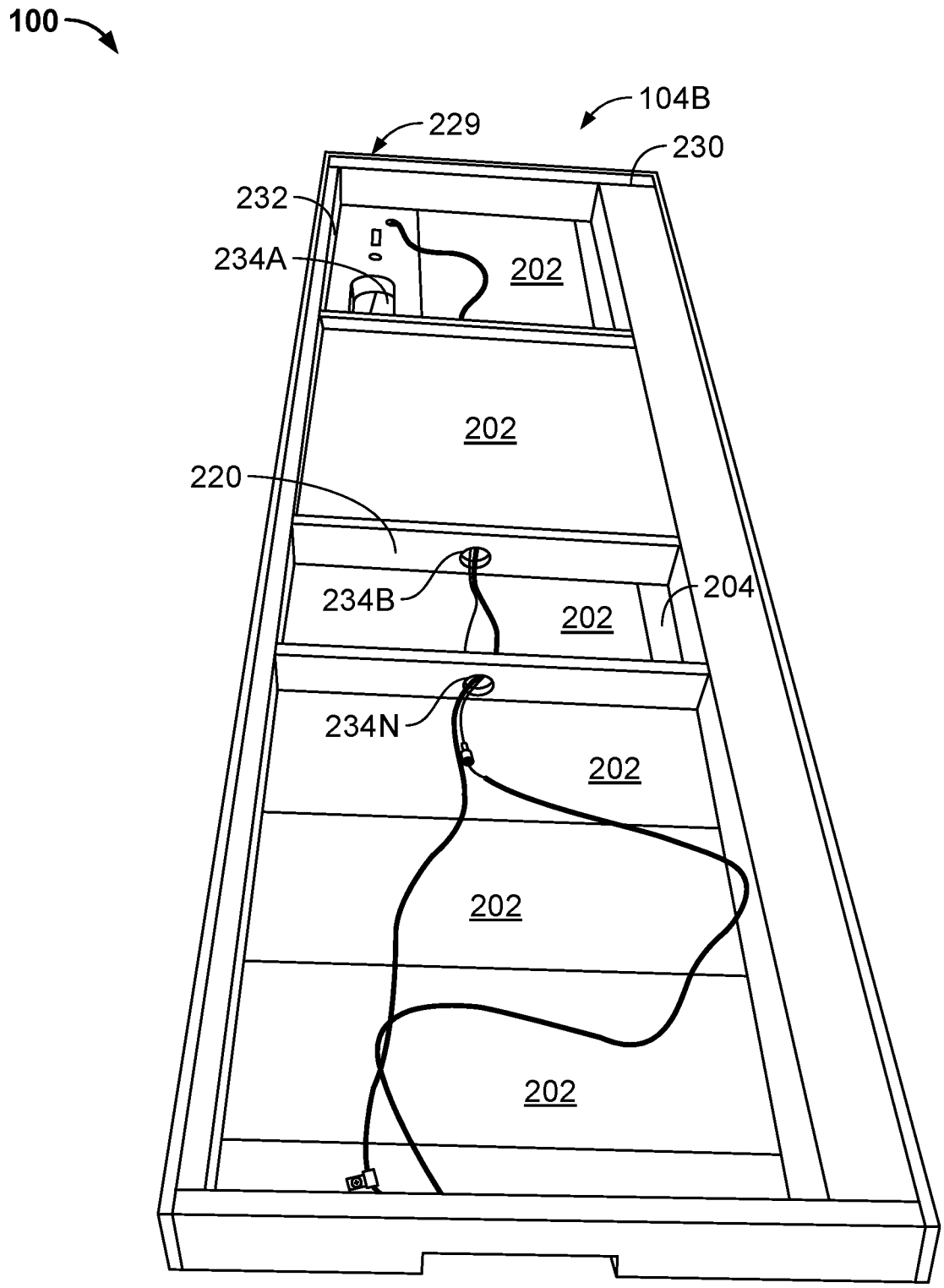

FIGS. 2A-C depict example headboard 102 configurations with sound insulation material 202. A back side 212 of the headboard 102 is shown in FIG. 2A. A cavity 214 can be defined in the back side 212 of the headboard 102. The cavity 214 can be sized to receive an insulation support frame 216. The insulation support frame 216 can extend around a perimeter of the cavity 214 to provide structural support to the headboard 102.

Vertical insulation supports 218 can be positioned inside the cavity 214 within the insulation support frame 216 to provide additional structural support to the headboard 102. The vertical insulation supports 218 can be equally spaced apart. The headboard 102 can include two vertical insulation supports 218, as shown in FIG. 2A. However, the headboard 102 can include fewer or additional vertical insulation supports 218 in some implementations.

Horizontal insulation supports 220 can also be positioned inside the cavity 214 within the insulation support frame 216 to provide additional structural support to the headboard 102. The horizontal insulation supports 220 can be equally spaced apart. The headboard 102 can include five horizontal insulation supports 220, as shown in FIG. 2A. However, the headboard 102 may also include fewer or additional horizontal insulation supports 220.

A support board 222 can extend along a bottom portion of the cavity 214 within the insulation support frame 216. The support board 222 can be configured to provide structural support around an area of the headboard 102 that connects or otherwise attaches to the side rails 110A and 110B of the foundation 108 (e.g., refer to FIG. 1). The support board 222 can include an opening 224 at a midpoint of the support board 222. The opening 224 can be configured to receive wiring and/or controller components of the bed system 100.

Furthermore, as shown in FIG. 2A, sound insulation material 202 can be sized to fit into each cavity 204 formed by the vertical insulation supports 218 and the horizontal insulation supports 220. Therefore, the sound insulation material 202 can be a thicker material that fills an entirety of each cavity 204. The sound insulation material 202 can be approximately 10-60 mm in thickness. One or more other ranges of thickness are also possible.

In some implementations, the sound insulation material 202 can be a sheet of material mounted to a front of the vertical insulation supports 218 and the horizontal insulation supports 220 in the cavity 214 (e.g., a side of the supports 218 and 220 that is closest to a front side of the headboard 102). In some implementations, multiple sheets of sound insulation material 202 can be used, where each sheet covers a different portion of the cavities 204 formed by the vertical insulation supports 218 and the horizontal insulation supports 220. In some implementations, a sheet of sound insulation material 202 can fill each individual cavity 204 or otherwise be placed within each cavity 204.

The insulation support frame 216, the vertical insulation supports 218, the horizontal insulation supports 220, and the support board 222 can be made of a wood material. The components 216, 218, 220, and/or 222 can also be made of other similar materials and/or other sturdy materials. A quantity of vertical insulation supports 218 and horizontal insulation supports 220 can add to structural integrity of the headboard 102. The quantity of supports 218 and 220 can also maintain a clean, even, and smooth surface for an upholstery fabric material to wrap around the headboard 102. In some implementations, additional or fewer supports 218 and/or 220 can be included in the headboard 102.

In FIG. 2A, the back side 212 of the headboard 102 is open to show a configuration of components therein. After the headboard 102 is manufactured, the back side 212 of the headboard 102 can be covered with a fabric, such as the upholstery fabric material that is used on the headboard 102 and other components of the bed system 100 (e.g., the side rails of the foundation).

Referring to FIG. 2B, the headboard 102 can include a main headboard portion 201 and the wings 104A and 104B. The wings 104A and 104B can be attached to lateral edges 206A and 206B, respectively, of the main headboard portion 201 such that the wings 104A and 104B are positioned opposite of each other. The headboard 102 can include insulation supports 200 positioned in each of the main headboard portion 201 and the wings 104A and 104B. The insulation supports 200 can extend from top portions 208 to bottom portions 210 of each of the main headboard portion 201 and the wings 104A and 104B.

The insulation supports 200 can extend vertically to define cavities 204 between adjacent insulation supports 200 such that sound insulation material 202 can be positioned in the cavities 204 between the adjacent insulation supports 200. Each of the insulation supports 200 can be an elongate structure extending from the headboard top 208 to the headboard bottom 210, and the cavities 204 can be elongate and extend from the headboard top 208 to the headboard bottom 210, where each of the headboard top 208 and the headboard bottom 210 can be wooden boards or other materials (e.g. metals or synthetics) suitable for the application.

The cavities 204 can be undivided from the headboard top 208 to the headboard bottom 210. Accordingly, the sound insulation material 202 can be a sheet that fills an entire cavity 204 formed between adjacent insulation supports 200. In some implementations, the insulation supports 200 can define only a single cavity 204 in each of the wings 104A and 104B and many cavities 204 in the main headboard portion 201.

The insulation supports 200 can provide structure to the headboard 102. In some implementations, the insulation supports 200 can be equally spaced apart in the main headboard portion 201. In some implementations, spacing between the insulation supports 200 can vary. The insulation supports 200 are beneficial to ensure the sound insulation material 202 can stand up and remain in place within the headboard 102 to provide quality insulation and noise reduction. Without the insulation supports 200, some embodiments of the sound insulation material 202 may slide down towards the headboard bottom 210 of the headboard 102.

As shown in FIG. 2B, the sound insulation material 202 can be fitted and placed in between each of the adjacent insulation supports 200. A soft upholstery material can be configured over the insulation supports 200 and the sound insulation material 202, as shown in FIG. 1. In other words, the sound insulation material 202 can be bonded to an internal facing side of the upholstery material. The soft upholstery material can be aesthetically pleasing. In some implementations, an acoustic fabric can be bonded onto the soft upholstery material to provide additional noise reduction and/or cancellation. Each of the main headboard portion 201 and the wings 104A and 104B, having the insulation supports 200 and the sound insulation material 202, can have a thickness of 3 to 4 inches. In other embodiments, the main headboard portion 201 and the wings 104A and 104B can have a greater or smaller thickness as suitable for the application.

Referring to FIG. 2C, A back side 229 of the wing 104B is shown. A cavity 230 can be defined in the back side 229 of the wing 104B, like the cavity 214 in the headboard 102, described in FIG. 2A. The cavity 230 can be sized to receive an insulation support frame 232. The insulation support frame 232 can extend around a perimeter of the cavity 230 to provide structural support to the wing 104B.

Horizontal insulation supports 220 can also be positioned inside the cavity 230 within the insulation support frame 232 to provide additional structural support to the wing 104B. The horizontal insulation supports 220 can be equally spaced apart. In some implementations, as shown in FIG. 2C, the horizontal insulation supports 220 may not be equally spaced apart. The wing 104B can include three horizontal insulation supports 220, as shown in FIG. 2C. However, the wing 104B may also include fewer or additional horizontal insulation supports 220.

Sound insulation material 202 can be sized to fit into each cavity 204 formed by the horizontal insulation supports 220. Therefore, the sound insulation material 202 can be a thicker material that fills an entirety of each cavity 204. The sound insulation material 202 can be approximately 10-60 mm in thickness, as described throughout this disclosure. One or more other ranges of thickness are also possible.

In some implementations, the sound insulation material 202 can be a sheet of material mounted to a front of the horizontal insulation supports 220 in the cavity 230 (e.g., a side of the supports 220 that is closest to a front side of the wing 104B). In some implementations, multiple sheets of sound insulation material 202 can be used, where each sheet covers a different portion of the cavities 204 formed by the horizontal insulation supports 220. In some implementations, a sheet of sound insulation material 202 can fill each individual cavity 204 or otherwise be placed within each cavity 204.

The insulation support frame 232 and the horizontal insulation supports 220 can be made of a wood material. The components 232 and 220 can also be made of other similar materials and/or other sturdy materials. A quantity of horizontal insulation supports 220 can add to structural integrity of the wing 104B. The quantity of supports 220 can also maintain a clean, even, and smooth surface for an upholstery fabric material to wrap around the wing 104B as well as the headboard 102 and the wing 104A.

In FIG. 2C, the back side 229 of the wing 104B is open to show a configuration of components therein. After the wing 104B is manufactured, the back side 229 can be covered with a fabric, such as the upholstery fabric material that is used on the headboard 102 and other components of the bed system 100 (e.g., the side rails of the foundation). Moreover, although components are described in reference to the wing 104B, the same/similar components can also be configured and included in the wing 104A. The wings 104A and 104B can have a same and/or similar configuration of components.

Figure 3:
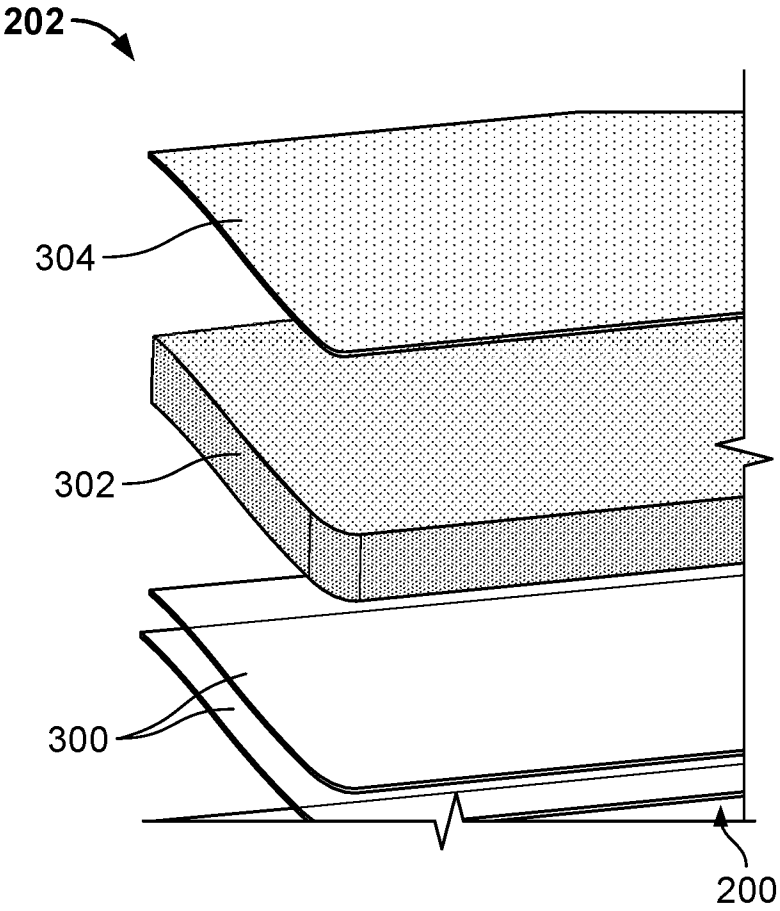
FIG. 3 depicts an example layering of materials in the sound insulation material in the headboard of the bed system.

FIG. 3 depicts an example layering of materials in the sound insulation material 202 in the headboard of the bed system. Multiple layers of materials can be bonded together to form the sound insulation material 202. The sound insulation material 202 can then bonded or otherwise attached to each of the insulation supports 200.

Various types of materials can be used to absorb sound and reduce sound reverberation. Some sound insulation materials 202 can include acoustic foam, sound insulation, and acoustic fabrics. Acoustic foam can be made of polyurethane and/or melamine foam. The surface of acoustic foam can feature wedges, cones, and/or cuboid shapes. Some sound insulation materials 202 can be made of mineral wool, rock wool, and/or fiberglass. The sound insulation material 202 can be designed to fit in between structures such as the insulation supports 200. Wool batten insulation, for example, can fit snugly between the insulation supports 200 to take up airspace that may otherwise transmit sound. Acoustic fabrics can use a tight weave to prevent sound from passing through the headboard. Thus, acoustic fabrics can absorb noise and prevent the noise from bouncing and disrupting the user of the bed system. One or more other materials can be used. Such materials can reduce noise in the surrounding sleep environment based on a thickness and tightness of the materials' weaves. When such materials are paired with insulating materials, the sound insulation material 202 can absorb sound and provide an improved sleep experience for the user of the bed system.

In the example of FIG. 3, the sound insulation material 202 comprises 3 layers. In some implementations, a total thickness of the sound insulation material 202 can be approximately 20 mm, which can achieve noise reduction of approximately 20 decibels (dB). In some implementations, the sound insulation material 202 can have a total thickness of approximately 10-60 mm, as described above. Furthermore, the noise reduction can be within a range of 10-40 dB, in some implementations. The sound insulation material 202 can have a first layer 300 can be a layer of glue for attaching the sound insulation material 202 to the insulation supports 200. The first layer 300 can be an oily glue. The first layer 300 can be used to adhere the sound insulation material 202 to an inside of the headboard (e.g., between the insulation supports 200). In some implementations, the first layer 300 can be a water-based glue and/or any other type of adhesive. A second layer 302 of high density sound insulation board can be layered on top of the first layer 300. As described throughout this disclosure, the second layer 302 can include natural fibers, including but not limited to mineral wool, rock wool, and/or cotton. The second layer 302 can also be made of fiberglass and/or a combination of recycled materials, such as plastics and/or fabrics. A third layer 304 of wear-resistant felt material can be layered on top of the second layer 302. The third layer 304 can be any type of wear-resistant fabric, including but not limited to cotton, polyester, and/or rayon. The first layer 300, the second layer 302, and the fourth layer 304 can be bonded together when the sound insulation material 202 is manufactured and placed between the insulation supports 200 of the headboard.

Figure 4A:
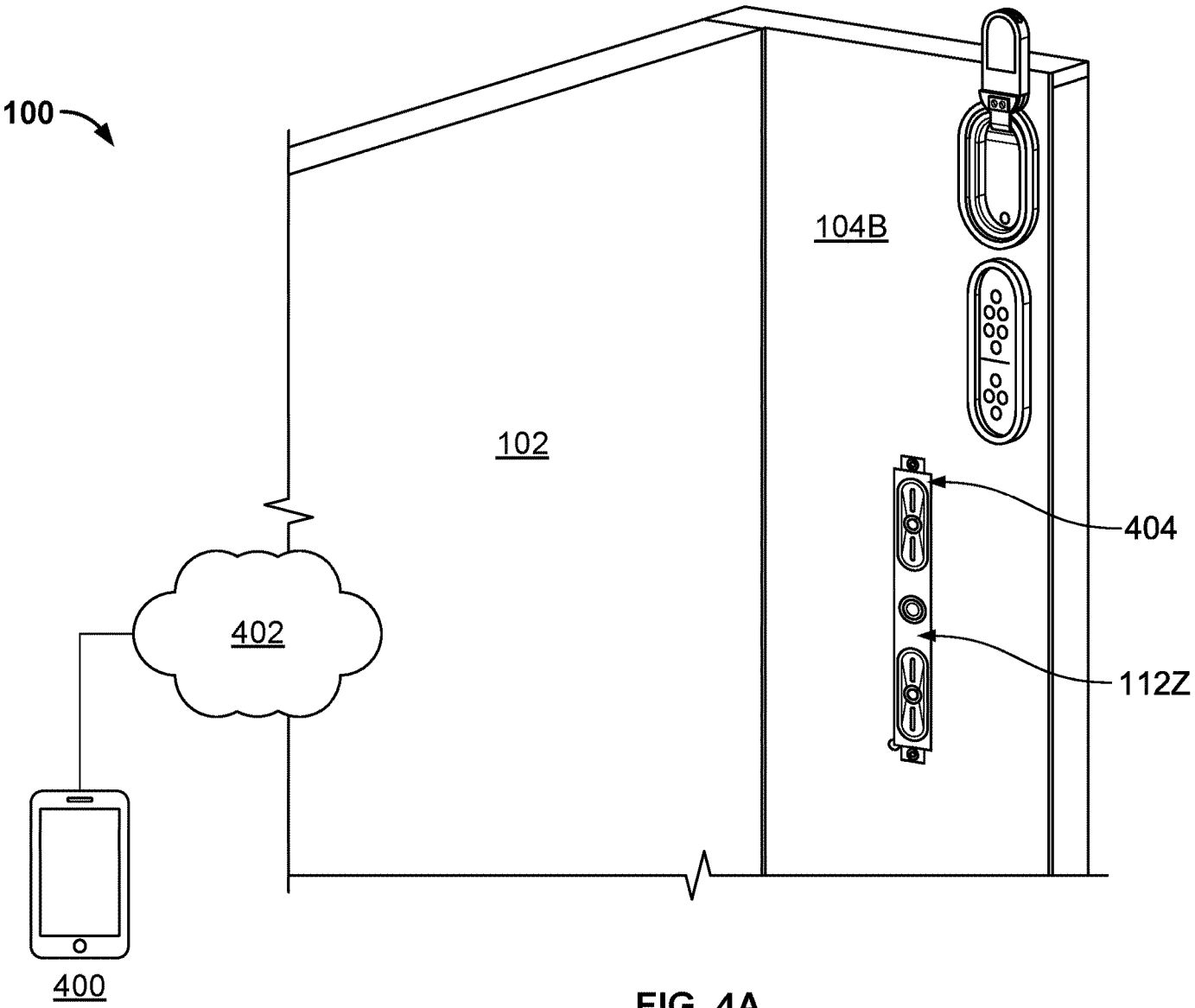
FIGS. 4A-B are conceptual diagrams of using integrated speakers in the headboard for noise reduction and/or noise cancellation.
Figure 4B:
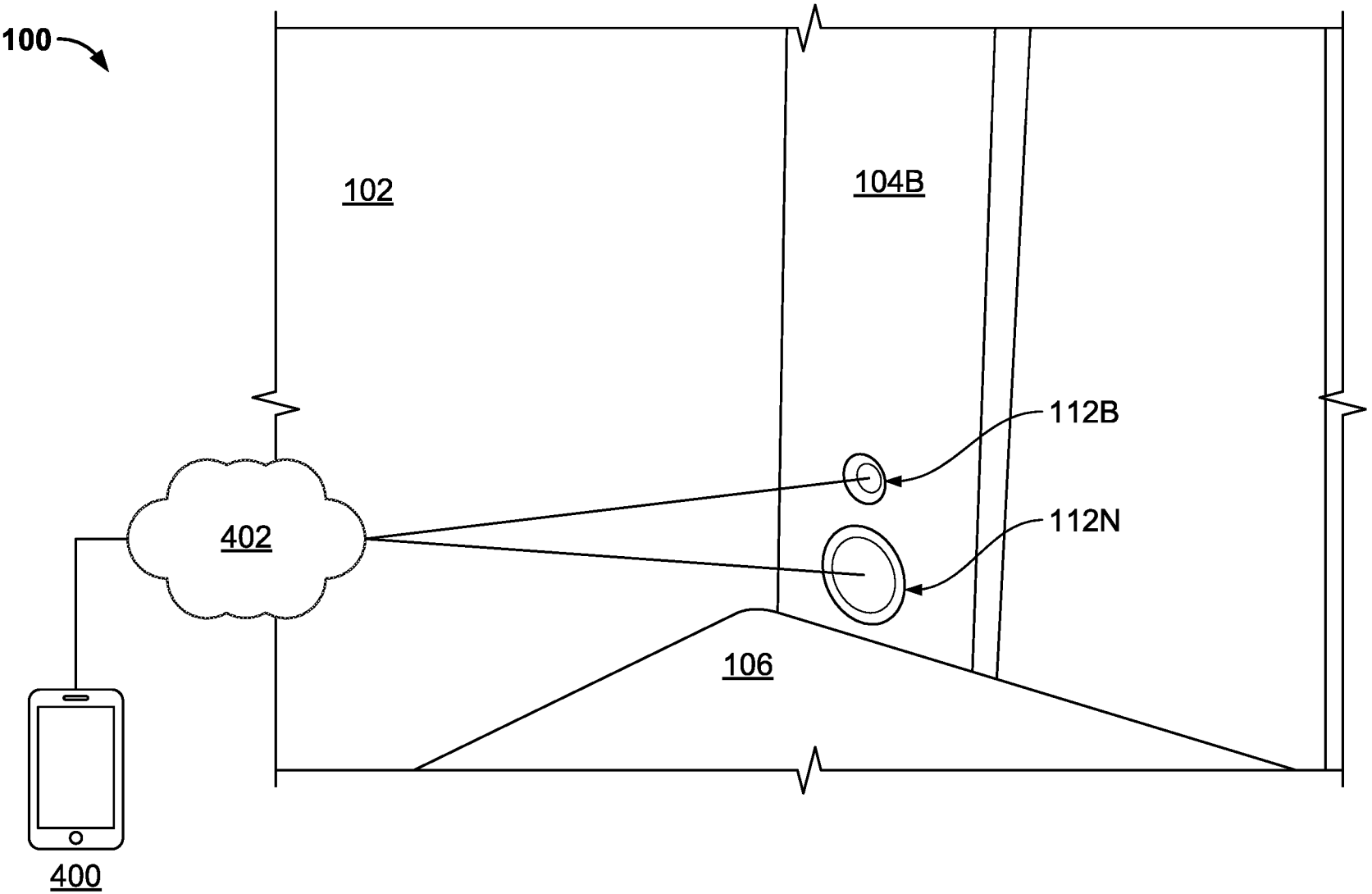

FIGS. 4A-B are conceptual diagrams of using integrated speakers in the headboard 102 for noise reduction and/or noise cancellation.

Referring to FIG. 4A, the wing 104B can include a cavity 404 for receiving a speaker 112Z. The cavity 404 can be sized to fit a rectangular speaker that can be bolted/screwed into the wing 104B. The cavity 404 can be positioned at a midpoint of the wing 104B. In some implementations, the cavity 404 can be equidistant from both a top portion and a bottom portion of the wing 104B. In some implementations, the cavity 404 can be closer to a top of a mattress than the top portion of the wing 104B. Although only one wing is depicted in FIG. 4A, the configuration of the speaker 112Z in the wing 104B can also be used in the wing 104A.

Alternatively or optionally, as shown in FIG. 4B, the speakers 112B and 112N can be integrated into the wing 104B of the headboard 102. Although only one wing is depicted in FIG. 4B, the configuration of the speakers 112B and 112N in the wing 104B can also be used in the wing 104A (e.g., refer to FIGS. 5A-B).

The wing 104B can include 2 or more speakers, speakers 112B and 112N. The speakers 112B and 112N can face the opposite wing, wing 104A (not depicted). The wing 104B can include additional or fewer speakers in some implementations. The speakers 112B and 112N can be positioned at a height that is close to or near a height of a user's head when it is resting on a pillow. For example, the speakers 112B and 112N can be positioned at or above the user's ears, which can be within a range of 25-40 inches above a ground surface on which the bed system 100 rests. Thus, audio that is played through the speakers 112B and 112N can be close to the user's ear and can have a greater impact on reducing or otherwise cancelling noise in the surrounding sleep environment. The sound insulation material 202 described throughout this disclosure can also be positioned around the speakers 112B and 112N to provide additional noise reduction and/or cancellation for the user of the bed system 100.

In some implementations, the speakers 112B and 112N can be different sizes. For example, the speaker 112B can be smaller and positioned a distance above the speaker 112N in the wing 104B, which can be larger. The speakers 112B and 112N can work in tandem with each other. In some implementations, the speaker 112B can be a tweeter, which means the speaker 112B can play high-range sounds. The speaker 112N, on the other hand, can be a mid-range speaker that can play mid-range sounds. In some implementations, the speakers 112B and 112N may also be connected to a sub-woofer. One or more additional speakers can be integrated into other portions of the headboard 102, such as the main headboard portion 201 shown in FIG. 2B.

Referring to both FIGS. 4A-B, during operation, the user of the bed system 100 may decide that they want to play audio through the speakers 112Z in FIG. 4A or 112B and 112N in FIG. 4B. For example, the user may detect external noises in the surrounding environment and/or a partner snoring on the mattress 106 and thus want to reduce or otherwise cancel such noise. The user can pair their user device 400 to the speakers 112Z in FIG. 4A or 112B and 112N in FIG. 4B using network(s) 402. The user device 400 can be any type of device that can provide audio input, including but not limited to a mobile phone, smartphone, laptop, tablet, wearable device, other computer, etc. The network(s) 402 can be a local network, including but not limited to Bluetooth and/or WiFi.

Once the user device 400 is paired with the speakers 112Z in FIG. 4A or 112B and 112N in FIG. 4B, the user can select the audio and/or types of sounds to play through the respective speakers. The user can make this selection at the user device 400, for example by using a mobile application that communicates with components of the bed system 100. Accordingly, the user can play white noise and/or pink noise through the speakers in order to reduce and/or cancel the surrounding noises.

The user can also adjust audio that is played through the speakers. For example, the user can adjust a volume of the audio. The user can also turn the audio on or off. Moreover, the user can set a time to turn the audio on or off. Any of these adjustments can be made using the user device 400 and/or a remote control for the user's side of the bed system (e.g., the remote 126B in FIG. 1).

Moreover, in some implementations, the user can selectively control each of the speakers. The user may desire to play audio through only one of the speakers (e.g., one of the speakers 112B and 112N in FIG. 4B). As another example, the user may desire to play different white noise and/or pink noise through the speakers. Moreover, the speakers 112B and 112N can be independently controlled for volume functions and for turning each of the speakers 112B and 112N on or off. For example, the user can increase volume of the speaker 112B and decrease volume of the speaker 112N. As another example, the user can turn on the speaker 112N and turn off the speaker 112B. The speakers 112B and 112N can both play the same sound or other user-selected audio. Moreover, the user can select any sound or sounds that they can access from their user device 400.

Figure 5A:
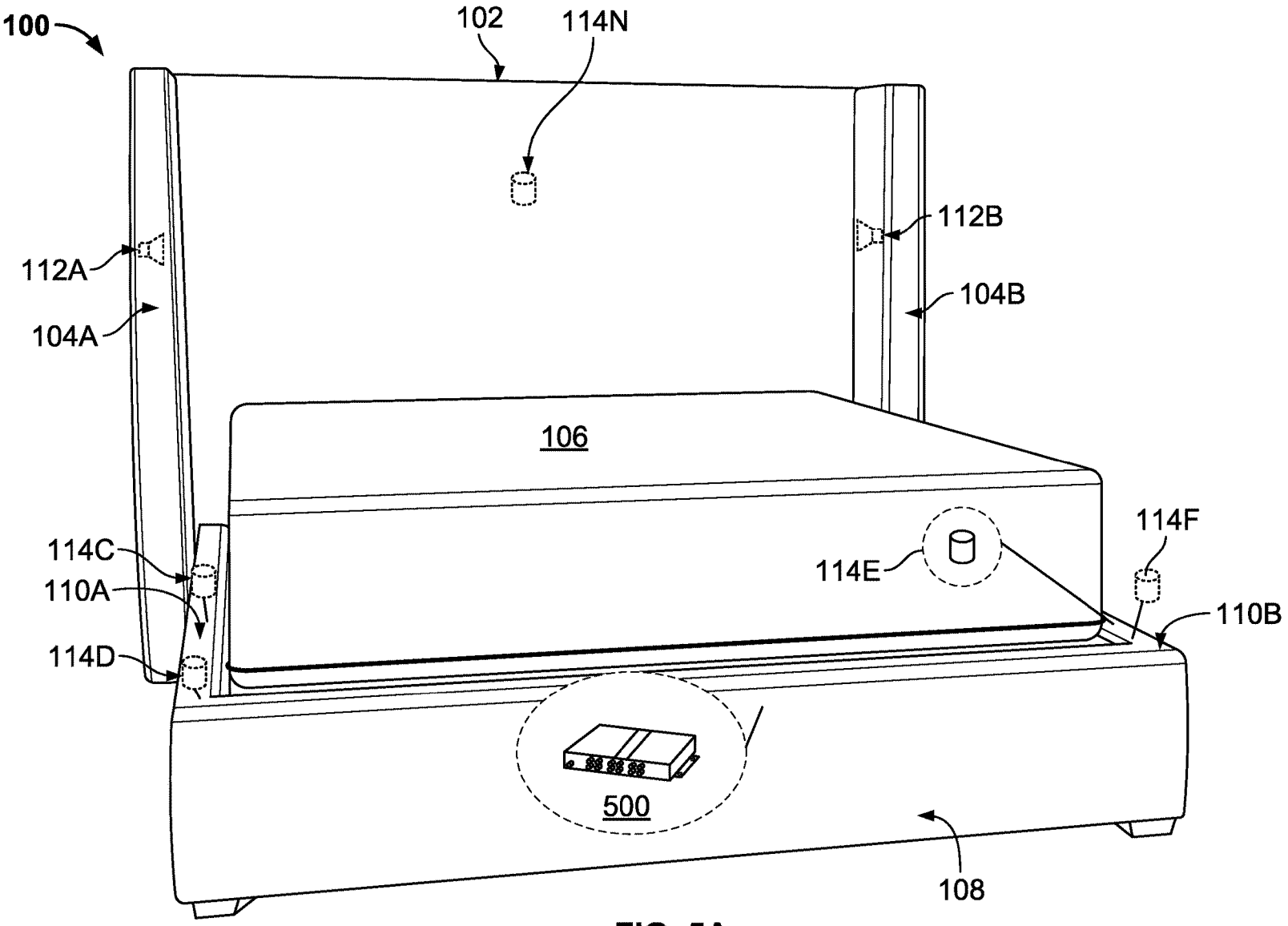
FIGS. 5A-B depict components of the bed system that can be used for noise reduction and/or noise cancellation techniques.
Figure 5B:
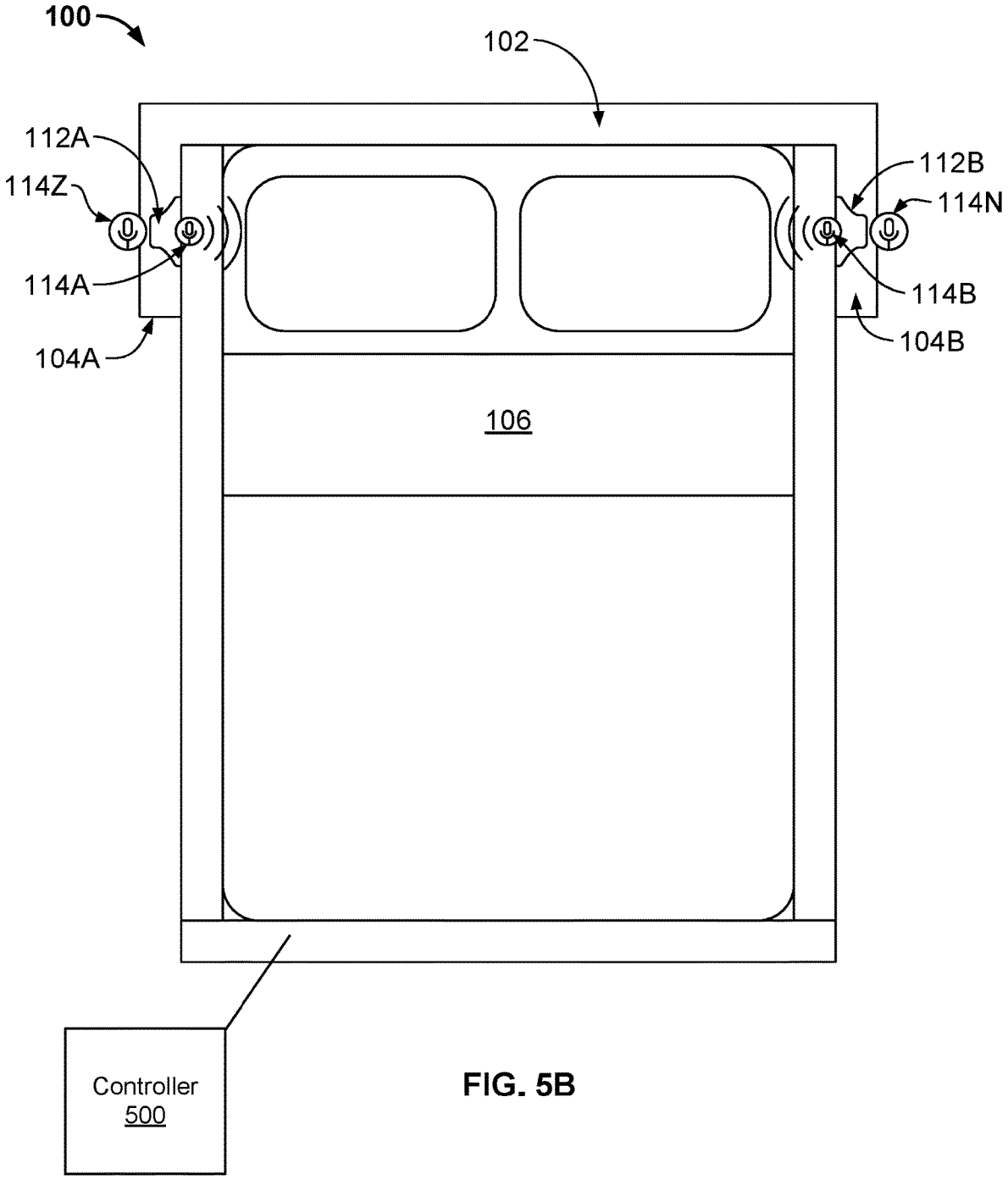

FIGS. 5A-B depict components of the bed system 100 that can be used for noise reduction and/or noise cancellation techniques.

Referring to FIG. 5A, the bed system 100 can include the speakers 112A and 112B integrated into the respective wings 104A and 104B of the headboard 102 as described throughout this disclosure. Multiple microphones can also be positioned throughout the bed system 100 to detect noise in the surrounding environment. For example, the microphone 114N can be integrated into a midpoint of the headboard 102. The microphone 114N can be a central microphone 114N that detects noise in the bed system 100. Surrounding microphones 114C, 114D, 114E, and 114F can be integrated into the side rails 110A and 110B of the foundation 108. More particularly, the microphones 114C and 114D can be integrated into the side rail 110A and the microphones 114E and 114F can be integrated into the side rail 110B. The microphones 114C and 114E can be integrated into the respective side rails 110A and 110B at a location closer to a head of the mattress 106 than a foot of the mattress 106. The microphones 114C and 114E can therefore detect noises closer to the head of the mattress 106. The microphones 114D and 114F can be integrated into the respective side rails 110A and 110B at a location closer to the foot of the mattress 106 than the head of the mattress 106. The microphones 114D and 114F can therefore detect noises closer to the foot of the mattress 106. A combination of audio signals detected by the microphones 114N, 114C, 114D, 114E, and/or 114F can be used by the controller 500 of the bed system 100 to generate audio that can be played through the speakers 112A and/or 112B to reduce or otherwise cancel the noise in the surrounding environment.

Alternatively or optionally, as shown in FIG. 5B, the bed system 100 can include the speakers 112A and 112B, microphones 114A, 114B, 114N, and 114Z, and a controller 500. The microphones 114A and 114Z can be integrated into the wing 104A of the headboard 102. The microphones 114B and 114N can be integrated into the wing 104B of the headboard 102. Each of the wings 104A and 104B can include additional or fewer microphones. In some implementations, as shown in FIG. 1, one or more additional microphones can be integrated into the headboard 102 near a head of the mattress 106. In some implementations, one or more additional microphones can be integrated into a foot end and/or side rails of the foundation of the bed system 100, as shown and described in FIG. 5A. A combination of microphones can be used to determine sound direction and reference signals that can be used by the controller 500. Similar to the speakers 112B and 112N described in FIGS. 4A-B, the sound insulation material 202 of the headboard 102 can be integrated around each of the microphones 114A, 114B, 114N, and 114Z to provide additional noise reduction and/or cancellation in the sleep environment.

The microphone 114A can be positioned on a side of the wing 104A that points in towards the mattress 106 and the wing 104B. As a result, the microphone 114A can detect noises on the mattress 106 nearest the wing 104A, such as a snore. Similarly, the microphone 114B can be positioned on a side of the wing 104B that points in towards the mattress 106 and the wing 104A. As a result, the microphone 114A can detect noises on the mattress 106 neared the wing 104B, such as a snore. The microphone 114Z can be positioned on an external side of the wing 104A and pointing out towards the surrounding sleep environment to detect surrounding, external noises nearest the wing 104A. Similarly, the microphone 114N can be positioned on an external side of the wing 104B and pointing out towards the surrounding sleep environment to detect surrounding, external noises nearest the wing 104B.

The controller 500 can be part of the bed system 100 and can be configured to control various aspects of the bed system 100, as described throughout this disclosure. For example, the controller 500 can selectively actuate one or more motors in the bed to articulate portions of a foundation and/or the mattress 106. The controller 500 can also selectively actuate and control other components of the bed system 100 based on user input that can be received from a user device and/or a remote control of the bed system 100. The controller 500 can be operably connected to the microphones 114A, 114B, 114N, and 114Z as well as the speakers 112A and 112B. The controller 500 can be configured to drive the speakers 112A and 112B to cancel noise in the surrounding environment as a function of input from at least one of the microphones 114A, 114B, 114N, and 114Z.

Referring to both FIGS. 5A-B, in operation, the controller 500 can receive sensed audio data from at least one of the microphones 114A, 114B, 114C, 114D, 114E, 114F, 114N, and 114Z. The controller 500 can determine, based on the sensed audio data, whether noise in the surrounding environment exceeds some threshold level of noise. The controller 500 can then drive, based on determining that the noise exceeds the threshold level of noise, at least one of the speakers 112A and 112B to cancel the noise. As described above, driving the speakers 112A and/or 112B to cancel the noise can include playing at least one of white noise and pink noise from the speakers 112A and/or 112B for a threshold period of time. The threshold period of time can be based on sensed audio data received from at least one of the microphones 114A, 114B, 114C, 114D, 114E, 114F, 114N, and 114Z. For example, the speakers 112A and/or 112B can continue to play audio until noise in the surrounding environment is less than the threshold level of noise.

Driving the speakers 112A and/or 112B to cancel the noise can include playing an inverse sound wave of the noise that is detected in the surrounding environment. For example, the controller 500 can determine a sound wave of the noise in the surrounding environment using the sensed audio data. The controller 50 can then generate an inverse sound wave of the sound wave of the noise in the surrounding environment. The controller 500 can drive the speakers 112A and/or 112B to play the inverse sound wave. Although the inverse sound wave may not sound like white noise or pink noise, the inverse sound wave can give off an effect of quieting noise in the surrounding environment.

As an illustrative example with FIG. 5B, if the microphones 114A and/or 114Z detect the sensed audio, the controller 500 can drive the speaker 112A so that the speaker 112A can cancel out noise nearest to a source of the noise. The controller 500 may not drive the speaker 112B since the speaker 112B may be farthest away from the source of the noise and audio data sensed by the microphones 114B and 114N may not exceed the threshold level of noise. Therefore, the controller 500 can selectively drive and control each of the speakers 112A and 112B independent of each other based on where the noise is detected and by which microphones of the bed system 100. The controller 500 can also calculate an average noise detected from the microphones 114A-114Z to then play an inverse wave of the average noise through the speakers 112A and 112B.

Figure 6:
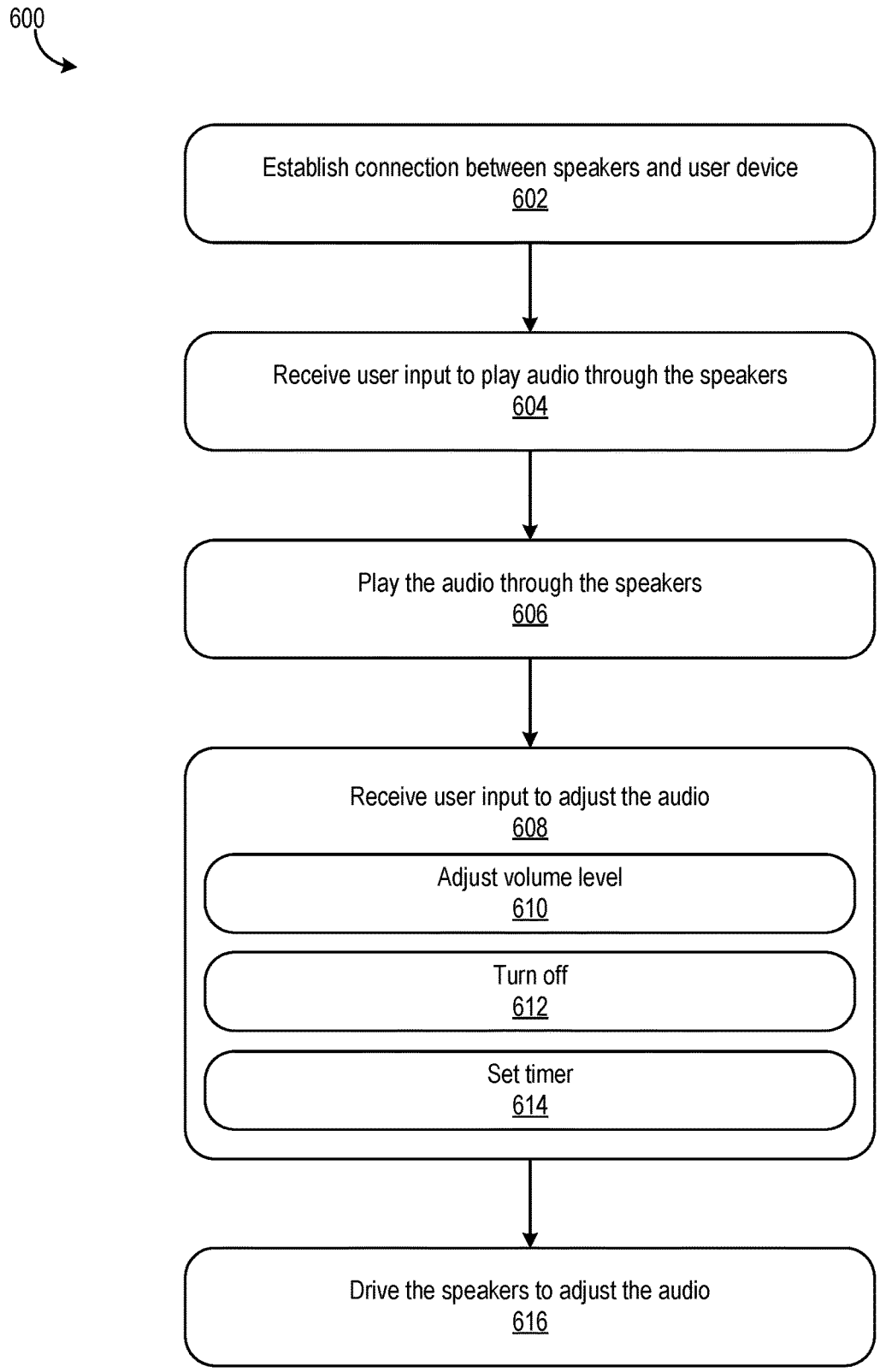
FIG. 6 is a flowchart of a process for reducing or cancelling noise in an environment using integrated speakers in the headboard.

FIG. 6 is a flowchart of a process 600 for reducing or cancelling noise in an environment using integrated speakers in the headboard. The process 600 can be performed by the controller 500. The process 600 can also be performed by one or more other computing systems, devices, user devices, computers, networks, cloud-based systems, cloud-based services, and/or remote cloud-based control systems. The process can be performed on a computer integral with the bed system, separate from the bed system but still local, and/or in the cloud or otherwise remote from the bed system. For illustrative purposes, the process 600 is described from the perspective of a controller.

Referring to the process 600, the controller can establish a connection between speakers of a bed system and a user device in block 602. As described herein, a user of the bed system can connect their user device, such as a mobile phone, to the speakers using Bluetooth. The user can also connect their user device to the speakers using one or more other wireless connections, including but not limited to WiFi. The user can connect their user device to only one speaker, such as a speaker that is integrated into a wing closest to the user's side of the bed. The user can also connect their user device to multiple speakers that are integrated into the wing closest to the user's side of the bed. As a result, the user can control what sounds/noise they hear while they are in bed without disturbing a partner's side of the bed. In some implementations, such as with a bed intended for one sleeper, the user can connect their user device to any or all speakers integrated into the bed system to cancel noise in the surrounding environment.

In block 604, the controller can receive user input to play audio through the speakers. For example, the user can select an option in a mobile application presented at the user device to play white noise or pink noise through at least one of the speakers. Using the mobile application, the user may be able to selectively control what audio is played through each of the speakers of the bed system. User selections in the mobile application can be transmitted via the Bluetooth connection to the controller. The controller can accordingly control/drive the speakers based on the user input.

For example, the controller can play the audio through the speakers in block 606. As mentioned, the controller can play particular audio through a speaker selected by the user in the mobile application. The user may choose to play white noise through one speaker and pink noise through another speaker. The controller can drive the respective speakers to play the user-selected white noise and pink noise. As another example, the user can select to play a first type of white noise through one speaker and a second type of white noise through another speaker. The controller can drive the respective speakers to play the user-selected first and second types of white noise. Similarly, the user can select to play white noise through one speaker at a first volume and white noise through another speaker at a second, different volume. The controller can accordingly drive the respective speakers to play the white noise at the first and second volumes.

In block 608, the controller can receive user input to adjust the audio. The user input can be received from the user device. The user input can also be received from a remote control of the bed system, as described above (e.g., refer to FIG. 1). The user input can include instructions to adjust a volume of the audio (e.g., increase or decrease the volume) (block 610), turn the audio off (block 612), and/or set a timer for how long the audio plays (block 614). Regarding block 614, the user may desire the audio to play only while the user is falling asleep. Thus, the user may set a timer to play the audio for 30 minutes or some other amount of time that the user believes it would take them to fall asleep. As another example, the user input can include instructions to turn off audio that is played through at least one of the speakers while leaving the audio playing through at least one other speaker. One or more other instructions can also be generated and provided as the user input to the controller.

Accordingly, the controller can drive the speakers to adjust the audio based on the received user input (block 616).

Figure 7:
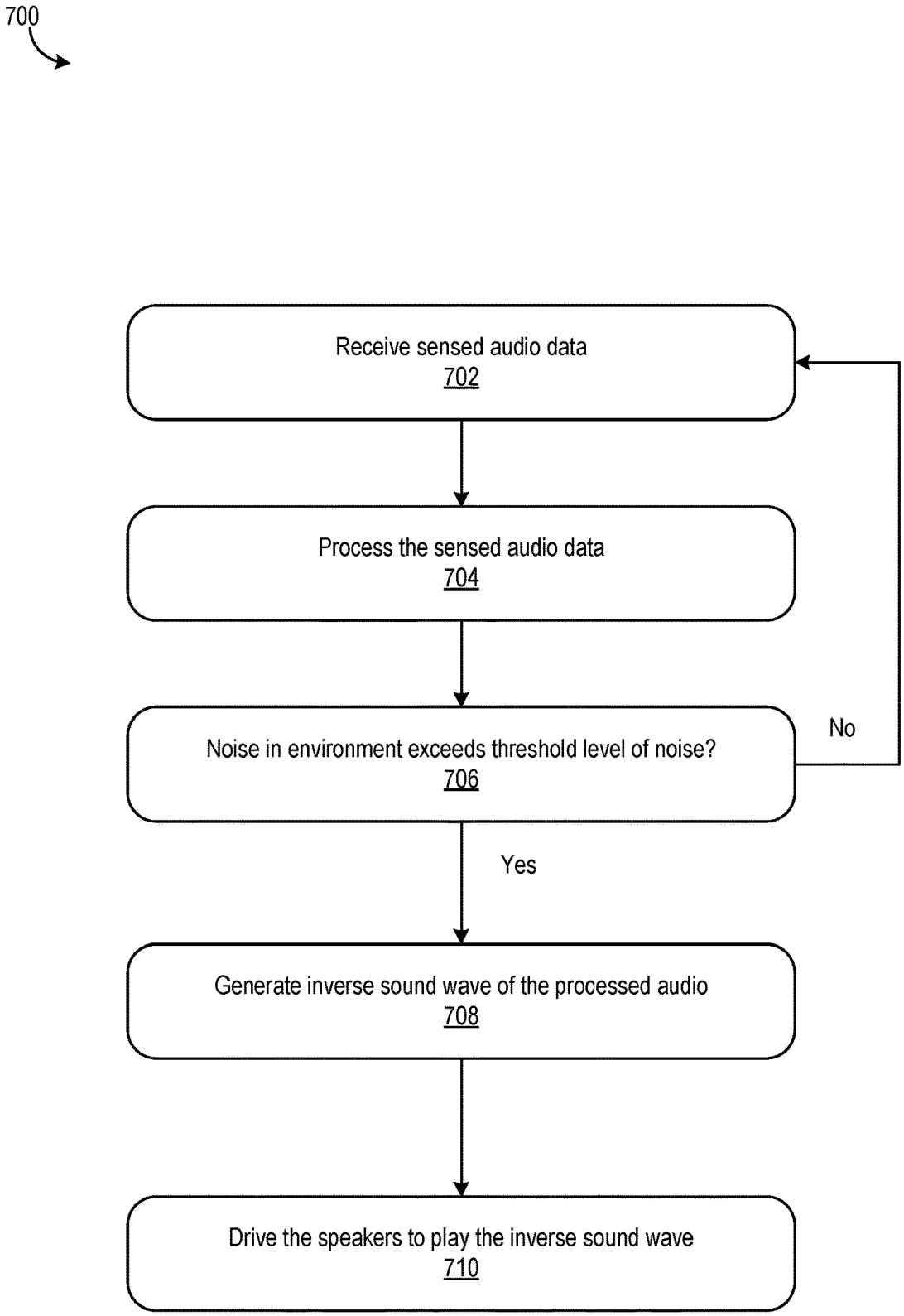
FIG. 7 is a flowchart of a process for automatically reducing or cancelling noise in the environment.

FIG. 7 is a flowchart of a process 700 for automatically reducing or cancelling noise in the environment. The process 700 can be performed by the controller 500. The process 700 can also be performed by one or more other computing systems, devices, user devices, computers, networks, cloud-based systems, cloud-based services, and/or remote cloud-based control systems. For illustrative purposes, the process 700 is described from the perspective of a controller.

Referring to the process 700, the controller can receive sensed audio data in block 702. As described above, microphones of the bed system can continuously sense audio data in the surrounding sleep environment and/or in the bed system, such as partner snore. The sensed audio data can be transmitted to the controller. In some implementations, the controller may receive the sensed audio data from only one microphone or a portion of microphones that is less than a total amount of microphones of the bed system. For example, the controller may receive sensed audio data from only one side of the bed system closest to where noise in the surrounding environment originates.

As an illustrative example, a noise can propagate as an acoustic wave to a position of any of the microphones. A noise source signal can be obtained by a reference sensor, together with an error signal measured by an error sensor. The combination of these signals can be used to adaptively adjust parameters of the controller to output a signal in an opposite phase of the acoustic wave to cancel the noise, as described in the process 700.

In block 704, the controller can process the sensed audio data. Processing the sensed audio data can include generating a sound wave for the audio data. Processing the sensed audio data can also include determining a side of the bed system from which the noise in the surrounding environment originates. In some implementations, the controller can determine the side of the bed based on which microphones detected the audio data.

The controller can determine whether noise in the processed audio data exceeds some threshold level of noise in block 706.

If the noise does not exceed the threshold level of noise, the controller can return to block 702. The controller can continue to monitor noise in the surrounding environment and repeat the process 700.

If the noise does exceed the threshold level of noise, the controller can generate an inverse sound wave of the processed audio (block 708). The inverse sound wave can serve to reduce a total noise in the surrounding environment rather than just covering the total noise with another sound. As a result, the perception of hearing a sound wave and its inverse wave at the same time can have an effect of reducing the total noise in the surrounding environment.

The controller can then drive at least one of the speakers of the bed system to play the inverse sound wave (block 710). For example, the bed system can drive a speaker or multiple speakers closest to where the noise was detected to play the inverse sound wave. The microphones, speakers, and controller can continuously receive inputs and generate outputs as the noise in the surrounding environment changes.

Figure 8:
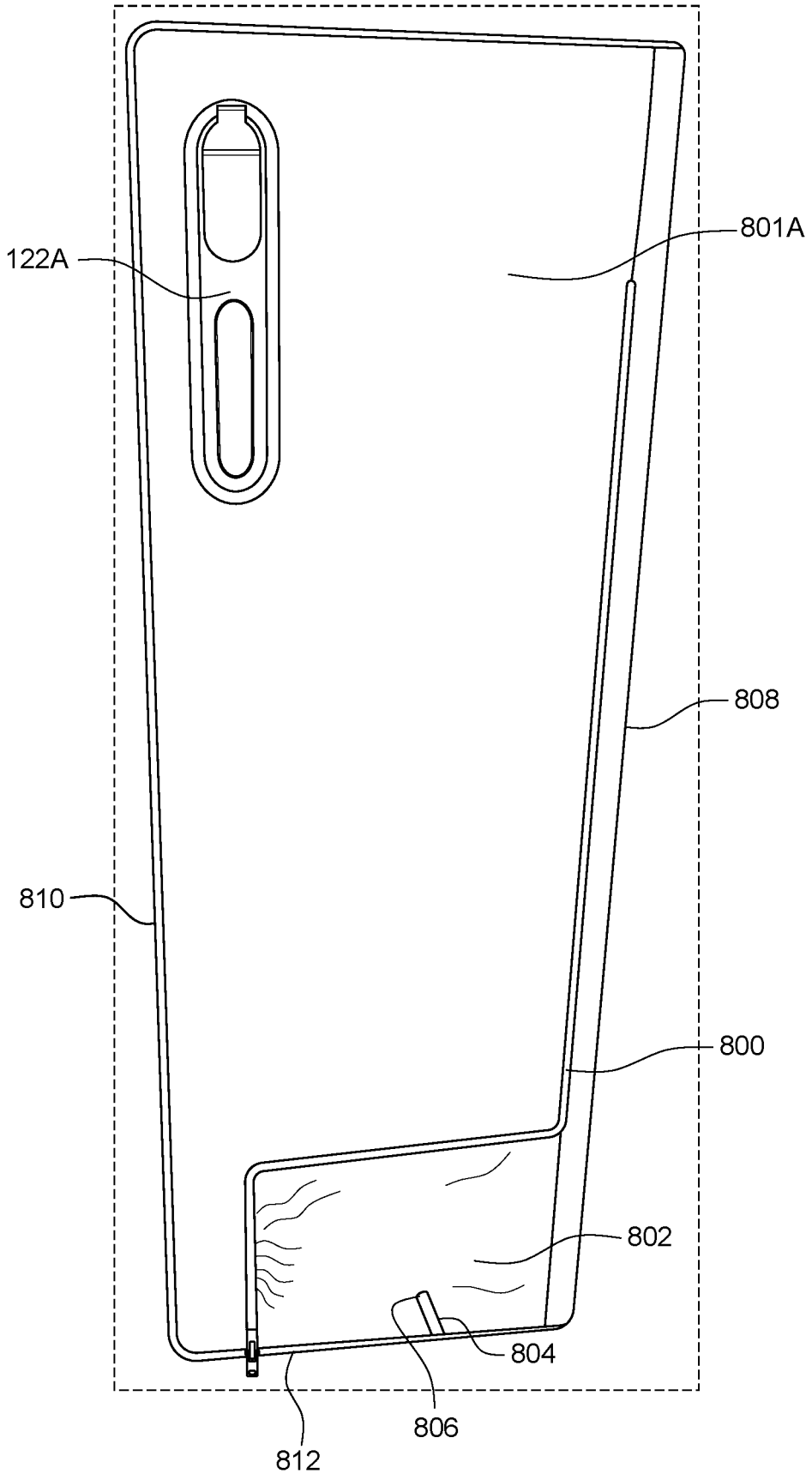
FIG. 8 depicts an example wing of the headboard described herein.

FIG. 8 depicts a wing 801A, which is an alternative embodiment of the example wing 104A of the headboard described herein. FIG. 8 shows the wing 801A detached from the main headboard portion 201 (not shown in FIG. 8). Here, the wing 801A includes a zipper 800 that extends partially along and inset from a rear edge 808 of the wing 801A. Closer to a bottom 812 of the wing 801A, the zipper 800 then curves horizontally across the wing 801A towards a front edge 810 of the wing 801A before extending vertically down the wing 801A to the bottom 812 of the wing 801A. Where the zipper 800 extends vertically down the wing 801A to the bottom 812 of the wing 801A, the zipper 800 can be a greater distance away from the front edge 810 than where the zipper 800 extends partially down and along the rear edge 808 of the wing 801A.

The zipper 800 can unzip from the bottom 812 of the wing 801A so that a flap 802 of the wing 801A can be pulled away, thereby exposing a portion of an interior of the wing 801A. The flap 802 can be made of a similar material as materials used for the wing 801A. In some implementations, the flap 802 can be made with a different material.

The speakers described herein, including but not limited to the speakers 112A-N in FIGS. 1, 4B, 5A, and 5B, can be accessible in the portion of the interior of the wing 801A that is exposed when the zipper 800 is unzipped and the flap 802 is pulled away. As a result of this design, if the speakers require replacement or maintenance, a user can simply access the speakers using the zipper 800 and replace or fix the speakers without having to replace the entire wing 801A with another wing. This design can advantageously reduce cost of maintenance and repairs. Furthermore, because the zipper 800 extends vertically down the wing 801A near the rear edge 808, the zipper 800 remains hidden from sight when the wing 801A is coupled to the main headboard portion 201 described throughout this disclosure. Similarly, the portion of the zipper 800 that extends horizontally across the wing 801A towards the front edge 810 of the wing 801A also remains hidden from sight by the side rail of the foundation when the wing 801A is coupled to the main headboard portion 201.

The flap 802 also includes an opening 806 through which electrical wires 804 associated with the speaker(s) can be routed. The electrical wires 804 can then connect to any power source described herein to provide power to the speakers that are accessible by unzipping the zipper 800 and pulling away the flap 802.

As shown in FIG. 8, the wing 801A includes the dock 122A. The dock 122A can, in some implementations, also be removable from the wing 801A for maintenance and repairs. As a result, the entire wing 801A may not have to be replaced by another wing if the dock 122A or components associated with the dock 122A, such as the light, requires any maintenance, repairs, or replacements.

Although FIG. 8 is described in reference to the wing 801A that connects to a left side of the main headboard portion 201 described herein, the wing 104B can also be modified to include some or all of the same or similar features as in the wing 801A.

While this specification contains many specific implementation details, these should not be construed as limitations on the scope of the disclosed technology or of what may be claimed, but rather as descriptions of features that may be specific to particular embodiments of particular disclosed technologies. For example, in some embodiments the same of insulation supports, speakers, headboards, mattresses, or other features can be varied as suitable for the application. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A bed system comprising:

a headboard comprising:

a main headboard portion;

a left wing attached to a first lateral edge of the main headboard portion, the left wing comprising a zipper that extends vertically down a portion of the left wing proximate a rear edge of the left wing and terminates at a bottom edge of the left wing, the zipper of the left wing is hidden from sight when the left wing attaches to the first lateral edge of the main headboard portion;

a right wing attached to a second lateral edge of the main headboard portion, wherein the left and right wings are positioned opposite of each other, the right wing comprising a zipper that extends vertically down a portion of the right wing proximate a rear edge of the right wing and terminates at a bottom edge of the right wing, the zipper of the right wing is hidden from sight when the right wing attaches to the second lateral edge of the main headboard portion;

sound insulation material positioned in each of the main headboard portion, the left wing, and the right wing; and insulation supports positioned in each of the main headboard portion, the left wing, and the right wing.

2. The bed system of claim 1, wherein the bed system further comprises a mattress, wherein the left and right wings extend a length along lateral edges of the mattress.

3. The bed system of claim 1, wherein:

some of the insulation supports extend vertically from top portions to bottom portions of the main headboard portion, and some of the insulation supports extend horizontally from the main headboard portion, the insulation supports are spaced apart such that the insulation supports form cavities within the headboard, some of the insulation supports extend horizontally from side portions between the top and bottom portions of the left wing and the right wing, the insulation supports are spaced apart such that the insulation supports form cavities within the left wing and the right wings, and the sound insulation material is configured to fill in the cavities.

4. The bed system of claim 1, wherein the sound insulation material comprises a first layer of glue that attaches the sound insulation material to the insulation supports, a second layer of high density sound insulation board that attaches to the first layer, and a third layer of wear resistant felt material that attaches to the second layer.

5. The bed system of claim 1, wherein the sound insulation material is at least one of wool batten insulation, high density foam, wool, polyurethane foam, melamine foam, mineral wool, rock wool, fiberglass, and acoustic fabric.

6. The bed system of claim 1, wherein each of the left wing and the right wing extend 10-15 inches from the first lateral edge and the second lateral edge of the main headboard portion, respectively.

7. The bed system of claim 1, wherein the insulation supports extend vertically to define cavities between adjacent insulation supports, wherein the sound insulation material is positioned in the cavities between the adjacent insulation supports.

8. The bed system of claim 7, wherein each of the insulation supports is an elongate structure extending from a headboard top to a headboard bottom, and wherein the cavities are elongate and extend from the headboard top to the headboard bottom.

9. The bed system of claim 1, wherein the insulation supports define only a single cavity in each of the left and right wings and define a plurality of cavities in the main headboard portion.

10. The bed system of claim 1, further comprising speakers integrated into the left and right wings that are configured to connect by a wireless communication protocol to a user device and play audio through the speakers.

11. The bed system of claim 10, wherein:

the zipper of the left wing is configured to unzip from the bottom edge of the left wing and expose an interior portion of the left wing that includes the speakers integrated into the left wing, wherein the speakers in the left wing are removable and replaceable; and the zipper of the right wing is configured to unzip from the bottom edge of the right wing and expose an interior portion of the right wing that includes the speakers integrated into the right wing, wherein the speakers in the right wing are removable and replaceable.

12. The bed system of claim 1, further comprising:

a noise cancelling system comprising:

at least one speaker; and a controller operably connected to the at least one speaker, wherein the controller is configured to drive the at least one speaker to cancel noise in an environment surrounding the bed system.

13. The bed system of claim 1, further comprising:

an insulation support frame that extends around a perimeter of a headboard cavity formed inside the main headboard portion, the insulation support frame comprising:

a first subset of the insulation supports that extends from a top portion to a bottom portion of the main headboard portion inside the headboard cavity, and a second subset of the insulation supports that extends from a first lateral edge to a second lateral edge between the top portion and the bottom portion of the main headboard portion inside the headboard cavity, wherein the first subset of the insulation supports and the second subset of the insulation supports intersect inside the headboard cavity to form insulation cavities, and the sound insulation material is configured to fill in the insulation cavities.

14. The bed system of claim 13, wherein the sound insulation material is a sheet of sound insulation material that mounts to a front side of the insulation support frame that is opposite and closer to a front end of the main headboard portion than a back end of the main headboard portion.

15. The bed system of claim 1, wherein the insulation supports extend vertically between top and bottom portions of the headboard and horizontally between side portions of the headboard to define cavities between adjacent and perpendicular insulation supports, wherein the sound insulation material is positioned in the cavities between the adjacent and perpendicular insulation supports.

16. A headboard for a bed, the headboard comprising:

a main headboard portion;

a left wing attached to a first lateral edge of the main headboard portion;

a right wing attached to a second lateral edge of the main headboard portion, the left and right wings are positioned opposite of each other, and wherein:

the left wing comprises a zipper that extends vertically down a portion of the left wing proximate a rear edge of the left wing and terminates at a bottom edge of the left wing; and the right wing comprises a zipper that extends vertically down a portion of the right wing proximate a rear edge of the right wing and terminates at a bottom edge of the right wing, wherein the zipper of the left wing is hidden from sight when the left wing attaches to the first lateral edge of the main headboard portion and the zipper of the right wing is hidden from sight when the right wing attaches to the second lateral edge of the main headboard portion.

17. A bed system comprising:

a headboard comprising:

a main headboard portion;

a left wing attached to a first lateral edge of the main headboard portion, wherein the left wing comprises a first speaker, wherein the left wing comprises a zipper that extends vertically down a portion of the left wing proximate a rear edge of the left wing to a bottom edge of the left wing, wherein at least a portion of the zipper of the left wing is hidden from sight when the left wing attaches to the first lateral edge of the main headboard portion, the zipper of the left wing is configured to unzip from the bottom edge of the left wing and expose an interior portion of the left wing that includes the first speaker integrated into the left wing, wherein the first speaker in the left wing is removable and replaceable through the zipper of the left wing; and a right wing attached to a second lateral edge of the main headboard portion, wherein the left and right wings are positioned opposite of each other and wherein the right wing comprises a second speaker, wherein the right wing comprises a zipper that extends vertically down a portion of the right wing proximate a rear edge of the right wing to a bottom edge of the right wing, and wherein a portion of the zipper of the right wing is hidden from sight when the right wing attaches to the second lateral edge of the main headboard portion, the zipper of the right wing is configured to unzip from the bottom edge of the right wing and expose an interior portion of the right wing that includes the second speaker integrated into the right wing, wherein the second speaker in the right wing is removable and replaceable through the zipper of the right wing.

18. The bed system of claim 17, further comprising:

a controller operably connected to the first speaker and the second speaker, wherein the controller is configured to drive the first and second speakers to cancel noise by playing at least one of white noise and pink noise from the first and second speakers for a threshold period of time.

19. The bed system of claim 17, wherein the first and second speakers are configured to connect by a wireless communication protocol to a user device and play audio through the first and second speakers.

20. The bed system of claim 17, further comprising:

sound insulation material positioned in each of the main headboard portion, the left wing, and the right wing, wherein the sound insulation material fills cavities around the first and second speakers; and insulation supports positioned in each of the main headboard portion, the left wing, and the right wing.

* * * * *